US006672403B2

(12) United States Patent
Ahr et al.

(10) Patent No.: US 6,672,403 B2
(45) Date of Patent: Jan. 6, 2004

(54) METHOD AND APPARATUS FOR PROTECTING A FLUID-OPERATED PERCUSSION DEVICE AGAINST NO-LOAD STROKES

(75) Inventors: Torsten Ahr, Essen (DE); Thomas Deimel, Mülheim (DE); Stefan Lohmann, Essen (DE)

(73) Assignee: Krupp Berco Bautechnik GmbH, Essen (DE)

( * ) Notice: Subject to any disclaimer, the term of this patent is extended or adjusted under 35 U.S.C. 154(b) by 0 days.

(21) Appl. No.: 10/134,442

(22) Filed: Apr. 30, 2002

(65) Prior Publication Data

US 2002/0185285 A1 Dec. 12, 2002

(30) Foreign Application Priority Data

May 12, 2001 (DE) ..... 101 23 202

(51) Int. Cl.[7] ..... B25D 9/14

(52) U.S. Cl. ..... 173/1; 173/115; 173/206; 173/207

(58) Field of Search ..... 173/1, 206, 207, 173/208, 115, 128, 17, 89, 152, 135

(56) References Cited

U.S. PATENT DOCUMENTS 5,064,005 A * 11/1991 Krone ..... 173/208
5,520,254 A * 5/1996 Weber ..... 173/128
5,529,132 A * 6/1996 Evarts ..... 173/1
5,860,481 A * 1/1999 Prokop et al. ..... 173/207
6,102,133 A * 8/2000 Scheid et al. ..... 173/208
6,334,495 B2 * 1/2002 Deimel et al. ..... 173/206
6,491,114 B1 * 12/2002 Webel ..... 173/207

FOREIGN PATENT DOCUMENTS

| | | |
|---|---|---|
| DE | 19636659 A1 | 3/1998 |
| DE | 10013270 A1 | 9/2001 |
| EP | 0919339 A1 | 6/1999 |
| EP | 0934804 A2 | 8/1999 |
| JP | 1080878 | 3/1998 |

* cited by examiner

*Primary Examiner*—Scott A. Smith
(74) *Attorney, Agent, or Firm*—Venable LLP; Norman N. Kunitz; James R. Burdett

(57) ABSTRACT

Depending on the working and application conditions, it may be desirable to equip fluid-operated percussion devices with a mechanism that protects against no-load strokes, particularly in the interest of avoiding undesired stress. In the present case, this protection mechanism is configured such that the control unit that influences the movements of the percussion piston is blocked by a safety element in the form of a multiple-position valve, and the percussion device is halted if the percussion piston overshoots the extended position occurring in normal operation by a defined distance, thereby assuming a no-load-stroke position. The safety element (21) that acts on the control unit (5) of the percussion device (1) is automatically controlled, notably such that it is not switched to be active until some time after the startup of the percussion device (1) acted on by the working pressure. The percussion device (1) can therefore start up without being influenced by the safety element (21).

33 Claims, 18 Drawing Sheets

METHOD AND APPARATUS FOR PROTECTING A FLUID-OPERATED PERCUSSION DEVICE AGAINST NO-LOAD STROKES

CROSS REFERENCE TO RELATED APPLICATION

This application claims the priority of German Patent Application No. 101 23 202.0 filed May 12, 2001, which is incorporated herein by reference.

BACKGROUND OF THE INVENTION

The invention relates to a method for protecting a fluid-operated percussion device against no-load strokes, having a percussion piston that moves inside a work cylinder and impacts a tool, the piston having two piston surfaces of different sizes, of which the smaller surface, being active in the direction of the return stroke, is permanently connected to a pressure line that is subjected to the working pressure, while the larger piston surface, being active in the direction of the work stroke, is alternately connected via a control valve to the pressure line and a pressure-relieved return line; a control unit that includes a distributing regulator, which moves inside the control valve and has two regulator surfaces that differ in size and are active in opposite directions of movement, with the smaller of the surfaces, which acts on the distributing regulator in the direction of the return-stroke position of the regulator, being permanently connected to the pressure line, and the larger regulator surface being connected only alternately and temporarily to the pressure line and the return line via a circumferential groove disposed between the piston surfaces; a no-load-stroke port that opens into the interior of the work cylinder, with the port first being opened toward the interior by the front piston collar of the percussion piston with the smaller piston surface after the percussion piston has overshot the normal impact position by an established distance in the work-stroke direction until it has assumed a no-load-stroke position; and a safety element, which is disposed upstream of the no-load-stroke port, and can be switched between two end positions—the inoperative position and the active position—and is connected on the intake side to the pressure line and serves in exerting the working pressure that originates from the safety element onto the no-load-stroke port in the active position, or, in the inoperative position, serves in breaking the connection between the pressure line and the no-load-stroke port, in which instance the working pressure exerted on the no-load-stroke port in the active position blocks the distributing regulator in the work-stroke position by way of the circumferential groove, should the percussion piston attain the no-load-stroke position.

The invention further relates to an apparatus that is suited for executing the method.

Depending on the working and application conditions, it may be desirable to equip fluid-operated percussion devices with a mechanism that protects against no-load strokes, particularly in the interest of avoiding an undesired stress or resulting damage. The Japanese published, non-examined patent application Hei-10-80878 of Mar. 31, 1998, proposes a solution relating to a hydraulic percussion device.

German Patent Application 100 13 270.7 of Mar. 17, 2000, proposes to equip a fluid-operated percussion device of the generic type mentioned at the outset with a manually-operated no-load-stroke protection mechanism in the form of a switchable safety element such that the percussion piston is shut down—independently of other control-related circumstances—should it reach a defined extended position in the direction of the work stroke.

SUMMARY OF THE INVENTION

It is the object of the invention to build upon the solution presented in the cited German patent application by providing a method and an apparatus that permit the no-load-stroke protection mechanism to be activated automatically, regardless of the manipulation of the device by an operator. The method and the apparatus are intended to be embodied such that the percussion device will not be shut down upon startup when it is subjected to the working pressure, but always can at least start up.

The object is accomplished according to a first aspect of the invention by a method of protecting a fluid-generated percussion devices of the type originally defined wherein the safety element is transferred from its inoperative position into its active position some time after the startup of the percussion device subjected to the working pressure—counter to the effect of a resetting mechanism that acts on the safety element. As a consequence of the operating mode of the percussion device, a larger activation force that counteracts the resetting action is generated continuously, or at least temporarily at recurring time intervals. This ensures that the safety element is always switched to be active due to the effect of the activation force after the percussion device has started up, in case the percussion piston moves in the work-stroke direction and may be able to reach the no-load-stroke position. As already mentioned, the subject of the invention can be embodied such that the safety element is either held continuously in the active position it has assumed once after the startup of the percussion device, or it is transferred again into its active position, at least in repeating intervals.

According to features of the invention, the method can be executed such that the safety element is transferred into its active position over the course of the first work cycle of the percussion piston or over the course of the first return-stroke movement of the percussion piston after the percussion device has started up. The work cycle encompasses the work-stroke and return-stroke movements, or the return-stroke and work-stroke movements, of the percussion piston. According to a teaching of the invention, the activation force acting on the safety element can be generated by the working pressure building up temporarily in a percussion-device line that is periodically subjected to pressure during the operation of the percussion device. Furthermore, the method can be embodied such that the safety element is temporarily transferred into its active position within the time frame, and maintained in this position while the percussion-device line is subjected to the working pressure.

The activation force acting on the safety element can be built up by the working pressure present in the no-load-stroke port. The safety element can, however, also be transferred into its active position if the larger piston surface of the percussion piston or the larger regulator surface of the distributing regulator is subjected to the working pressure for the first time after the percussion device has started up.

The method can also be embodied such that the safety element is gradually transferred into its active position, as a function of the operating period, after the percussion device has started up. For this to happen, a delay element can cause the safety element to execute a partial switching stroke per time unit in the direction of its active position, with the partial switching stroke being smaller than the switching stroke with which the safety element is transferred out of the inoperative position into the active position.

As an alternative, the control surface of the safety element can be supplied with a limited control volume, as a function of pressure fluctuations occurring periodically during the operation of the percussion device; consequently, the safety element is transferred in increments into the active position.

In a particularly simple embodiment of the subject of the invention, the limited control volume can be created by a percussion-device line equipped with a throttle element, which is periodically subjected to the working pressure during the operation of the percussion device. In this regard, the following lines in particular are considered as a percussion-device line: the alternating-pressure line, by way of which the larger piston surface of the percussion piston is temporarily exposed to the working pressure; the reversing line, by way of which the control valve of the percussion device can be switched into the work-stroke position; the short-stroke line, in the event that the percussion device is embodied to be switched between a long-stroke and a short-stroke mode; and the no-load-stroke line, whose mouth or port opens into the interior of the work cylinder.

In accordance with the invention, the limited control volume can also be created by a pump that conveys a constant volume for each work cycle during the operation of the percussion device. Also in this embodiment, the control surface, over which the safety element moves counter to the effect of the resetting mechanism, is only supplied with a limited control volume in numerous consecutive intervals. The control volume pushes the safety element in increments in the direction of its active position with each conveying action.

The above-mentioned conveying action can particularly be initiated when the pump is driven by a percussion-device line that is periodically subjected to the working pressure during the operation of the percussion device.

Within the scope of the invention, the aforementioned pump can also be replaced by other types of metering devices. In particular, it is possible to interpose a metering valve for acting on the control surface of the safety element, with the valve only briefly supplying a limited volume as a function of the change in certain pressure conditions that occurs repeatedly over time. As already mentioned, a percussion-device line that is periodically subjected to the working pressure can switch the metering valve between the blocking and flowing positions.

A suitable switching of the safety element can ensure that, after being transferred into the active position, the element is held in this position as long as the percussion device is being subjected to the working pressure.

The object of the invention is also accomplished according to a second aspect of the invention by an apparatus intended for executing the method that has the following features:

The safety element is an automatically-controlled two-position valve equipped with a resetting mechanism, and has a control surface that influences the mechanism's position. This surface can be acted upon, by way of a signal line, by a pressure level that forms a control signal such that the two-position valve is transferred from its inoperative position to its active position some time after the percussion device has started up, and counter to the effect of the resetting mechanism. Moreover, the two-position valve is embodied such that it maintains its active position, attained with the control signal, at least in temporary, repeating intervals.

If the apparatus is configured such that the two-position valve only temporarily maintains its active position—depending on the change in certain pressure conditions that occurs periodically in the operating mode of the percussion device —this naturally stipulates that the safety element must at least assume its active position during the work-stroke movement of the percussion piston, which can prevent no-load piston strokes anticipated to occur during this time. This is ensured in that the control valve is held securely in the work-stroke position by a corresponding exertion of pressure onto its relevant regulator surface; the control valve therefore can no longer be switched into its return-stroke position, and thus also cannot initiate the return-stroke movement of the percussion piston.

In a modification of the apparatus according to the invention, the signal line is connected to a percussion-device line, which is periodically subjected to the working pressure during the operation of the percussion device. The change in the pressure level occurring in repeating intervals in the relevant percussion-device line represents a signal that either causes the safety element to be transferred into its active position, or at least initiates the transfer.

The no-load-stroke line having the no-load-stroke port that opens into the interior of the work cylinder is particularly considered as a percussion-device line, as is the alternating-pressure line, by way of which the larger piston surface of the percussion piston is temporarily subjected to the working pressure, and the reversing line, by way of which the larger regulator surface of the distributing regulator that constitutes the control unit, is temporarily subjected to the working pressure.

If the percussion device has a pilot control that cooperates with the control unit, and a short-stroke line that is connected to the pilot control and the interior of the work cylinder, the signal line can also be connected to the short-stroke line within the scope of the inventive teaching.

A common feature of the above-mentioned embodiments of the apparatus is that a control signal that influences the safety element is triggered at different times after the percussion device has started up.

As an alternative to one of the above embodiments, the subject of the invention can also be configured such that the signal line itself is connected to the rear cylinder segment—independently of the alternating-pressure line—by way of which the larger piston surface of the percussion piston is temporarily subjected to the working pressure.

In another type of embodiment of the apparatus, the signal line is connected to the interior of the work cylinder such that the line is subjected to the working pressure by way of the front cylinder segment in the event that the percussion piston—seen in the direction of the return stroke—assumes a position outside of its normal impact position. In this case, the change in pressure conditions in the work-cylinder interior that occurs during the work cycles of the percussion piston is utilized to influence the position of the safety element.

The opening or port for the signal line into the interior of the work cylinder can be disposed at the level of the no-load-stroke port, or when seen in the direction of the return stroke of the percussion piston, can also be disposed in front of the no-load-stroke port. A crucial point in this connection is that the mouth of the signal line into the work-cylinder interior must be blocked by the percussion piston no later than when the piston has reached the impact position.

Moreover, the mouth or opening of the signal line into the interior of the work cylinder should be disposed in front of the mouth oar opening of the reversing line into the work-cylinder interior, when seen in the return-stroke direction of the percussion piston—but, in any event, at the level of this mouth.

If the percussion device can be switched between a long-stroke and a short-stroke mode, the mouth or opening of the signal line into the work-cylinder interior can be located in the region that is limited by the mouth of the short-stroke bore on one side and the mouth of the reversing line into the work-cylinder interior on the other side.

In principle, the apparatus can also be embodied such that the safety element is gradually transferred into its active position after the percussion device has started up (through the exertion of the working pressure). This can be effected particularly in that the section of the signal line that is connected so as to permit a flow to the control surface of the safety element is connected to the signal source that acts on it such that a limited control volume is at least intermittently— or, alternatively, continuously—supplied to the control surface after the percussion device has started up. This control volume causes the control surface either to execute a partial switching stroke per time unit, or advance in increments in the direction of the active position.

In this regard, embodiments that include a percussion-device line or a signal line that is connected to the interior of the work cylinder can be embodied correspondingly, i.e., the segment of the signal line that is connected to the control surface so as to permit a flow has a throttle element that acts as a delay element.

Because the pressure level in the relevant percussion-device lines and in the interior of the work cylinder changes periodically, the control surface of the safety element only advances in stages or steps in the direction of the active position under the additional influence of the throttle element.

In an embodiment having a continuous supply of a limited control volume, the segment of the signal line that is connected to the control surface so as to permit a flow is connected to the pressure line with the interposing of a throttle element that acts as a delay element. With the effect of the throttle element, which can be embodied as a throttle or baffle, the control surface is continuously supplied with a limited control volume per time unit; consequently, the safety element reaches its active position after a certain length of time.

The apparatus according to the invention can also be modified such that the segment of the signal line that is connected to the control surface of the safety element so as to permit a flow is equipped with a spring-loaded check valve, which blocks the signal line in the direction of the percussion-device line, or in the direction of the interior of the work cylinder. In this way, an undesired change in the pressure level in the percussion-device line or in the interior of the work cylinder can be barred from influencing the control surface of the safety element and changing the position of the element in a disadvantageous manner.

An apparatus similar to the switching mechanism of the safety element can be attained through the connection of a pump to the segment of the signal line that is connected to the control surface so as to permit a flow. This pump is driven such that it conveys a constant volume to the control surface per work cycle during the operation of the percussion device, which volume transfers the safety element into its active position in increments.

For switching the safety element into its inoperative position without a significant delay after the percussion device has been shut off, it should be ensured that the pressure level acting on the control surface can be suitably reduced. This can be effected in that the segment of the signal line that is connected to the control surface so as to permit a flow is additionally connected to the pressure line via a discharge line equipped with a spring-loaded check valve; in this instance, the check valve blocks the pressure line in the direction of the signal line.

If, after the percussion device has been shut off, the pressure level in the pressure line drops, the control surface can expel fluid into the discharge line and into the pressure line under the effect of the resetting mechanism when the check valve is open. Provided that the pressure line is subjected to the working pressure, the check valve assumes its blocking position, so the discharge line has no effect in the direction of the control surface of the safety element. As an alternative, the segment of the signal line that is connected to the control surface so as to permit a flow can additionally be connected to a throttle line, which is maintained in a pressure-relieved state through its connection to a throttle element disposed inside it. The throttle line can be pressure-relieved by being connected to the return line of the percussion device that terminates into the tank. After the percussion device has been shut down, the resetting mechanism of the safety element also influences the volume enclosed in front of the control surface, as described above, which volume can be carried off externally through the throttle line.

In an especially simple embodiment of the apparatus, the safety element is configured as an automatically-controlled 2/2-way valve. As an alternative, the safety element can also be configured as an automatically-controlled 3/2-way valve whose intake side is only connected to the pressure line, and whose discharge side is connected to the no-load-stroke mouth and to the signal line, with only the control surface being connected to the signal line in the inoperative position, and with the no-load-stroke mouth and the signal line that is connected to the control surface being subjected to the working pressure in the active position.

In a further embodiment of the apparatus according to the invention, the safety element is configured as an automatically-controlled 4/2-way valve whose intake side is connected to the pressure line and the signal line, and whose discharge side is connected to the no-load-stroke mouth and to an extension of the signal line, the extension being connected to the control surface so as to permit a flow. Furthermore, the 4/2-way valve is configured such that, in the inoperative position, the connection between the pressure line and the no-load-stroke mouth is broken, while the signal line and its extension are connected to one another. Finally, in the active position, the no-load-stroke port and the extension are subjected to the working pressure by way of the pressure line, and the signal line is blocked in the direction of the 4/2-way valve.

In the last mentioned embodiment, the safety element maintains the active position it has assumed once—through the appropriate effect on its control surface after switching—because in this position, the working pressure present in the pressure line is simultaneously exerted onto the control surface.

The invention is described in detail below by way of a plurality of exemplary embodiments that are illustrated in the drawing.

DESCRIPTION OF THE PREFERRED EMBODIMENTS

Figure 1:
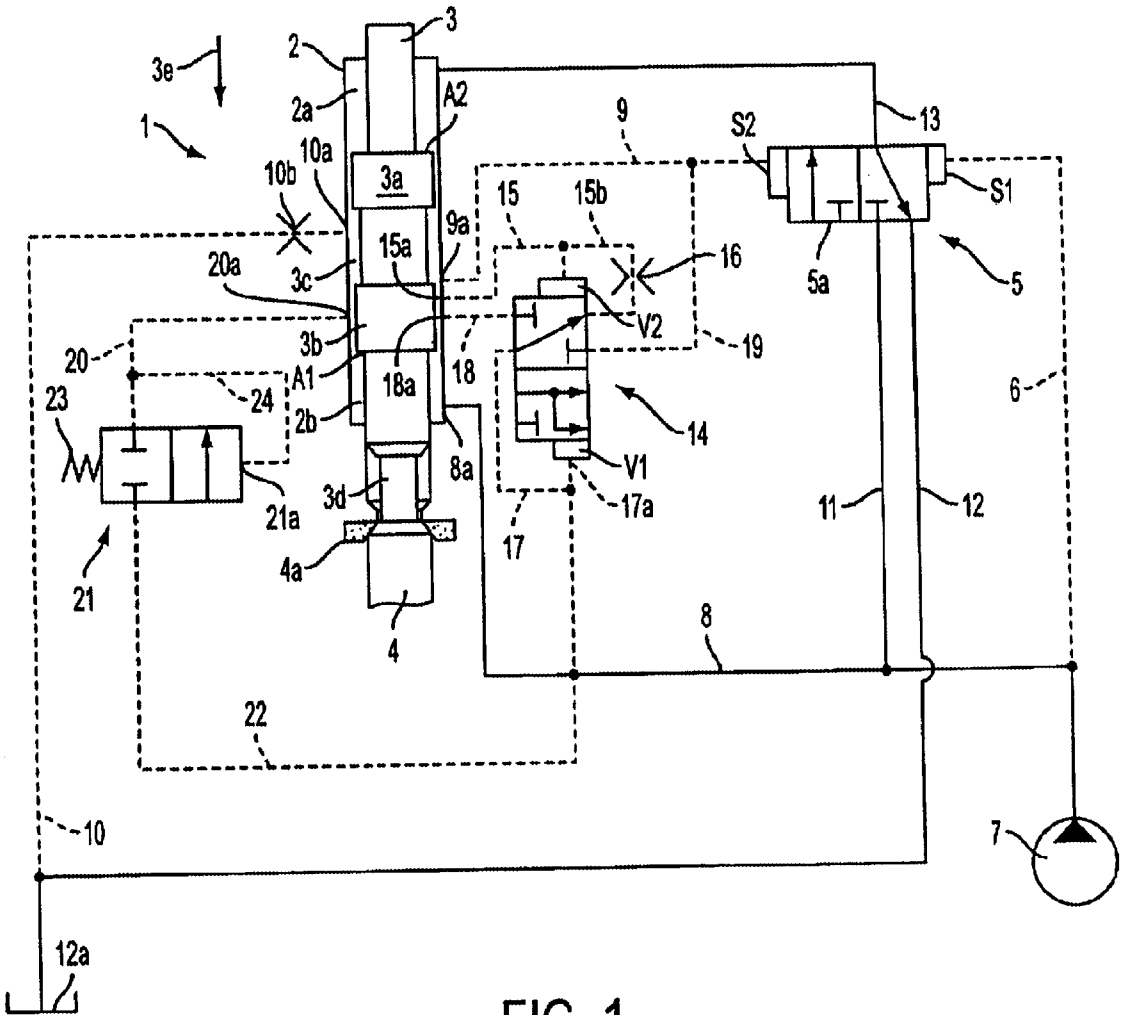
FIG. 1 is a circuit diagram of a percussion device embodied in accordance with the invention, with automatic stroke switching.

Referring now to FIG. 1, there is shown a percussion device, generally represented by 1, that has an automatic stroke-switching mechanism, and, in addition to the lines and drive and control elements to be described below, a work cylinder 2, in which a percussion piston 3 is held to move back and forth. The piston has two circumferential piston collars 3*a* and 3*b,* which are disposed inside the work cylinder 2 and are separated from one another by a circumferential groove 3*c*.

Together with the work cylinder 2, the outward-oriented piston surfaces A1 and A2 of the piston collar 3*b* and 3*a,* respectively, limit a front and a rear cylinder segment 2*a* and 2*b,* with the piston surface A1 being smaller than the piston surface A2. Outside of the work cylinder 2, the percussion piston 3 changes over to a piston point 3*d,* which is located opposite a tool in the form of a chisel 4. A stop 4*a* limits the chisel's play in the direction of the percussion piston 3. The movement of the percussion piston 3 in the direction of the work stroke is indicated by the arrow 3*e*.

The described illustration depicts the percussion device at the point at which the percussion piston 3 impacts the chisel 4. Normal operation is assumed here, that is, the chisel 4 does not penetrate the material to be reduced, and the percussion piston 3 accordingly assumes the provided, normal impact position.

The control mechanism for switching the movement of the percussion piston 3 comprises a distributing regulator 5*a,* which can move inside a control valve 5 and whose smaller regulator surface S1 is continuously subjected to the working pressure (system pressure) via a resetting line 6. An energy source in the form of a hydraulic pump 7 generates this working or system pressure.

The smaller piston surface A1 is also continuously subjected to the working pressure via a pressure line 8 that is connected to the resetting line 6. Relative to the work cylinder 2, the opening or port 8*a* of the pressure line 8 is disposed such that it always lies outside of the piston collar 3*b* and thus inside the front cylinder segment 2*b*.

A reversing line 9 connects the larger regulator surface S2 of the distributing regulator 5*a* to the interior of the work cylinder 2 such that, in the illustrated state, the port 9*a* of the line 9 is connected via the circumferential groove 3*c* to a pressure-relieved return line 10. The port 9*a* of the reversing line 9 and the port 10*a* of the return line are thus located opposite one another—seen in the longitudinal direction of the percussion piston 3—with a spacing in the axial direction of the piston 3 that is smaller than the axial length of the circumferential groove 3*c*.

A control line 11 connects the control valve 5 to the pressure line 8, while an outlet line 12 and a tank 12*a* connect the valve 5 to the return line 10. Moreover, an alternating-pressure line 13 connects the control valve 5 to the rear cylinder segment 2*a,* by way of which the larger piston surface A2 can be subjected to the working pressure, if necessary. The control valve 5 can assume two valve positions, namely the illustrated (right) return-stroke position, in which the alternating-pressure line 13 and the outlet line 12 relieve the pressure on the larger piston surface A2, and the (left) work-stroke position, in which the working pressure is exerted onto the rear cylinder segment 2*a* by way of the pressure line 8, the control line 11 connected thereto and the alternating-pressure line 13. When the control valve is in this position, the percussion piston 3 executes a work stroke in the direction of the arrow 3*e,* counter to the resetting force originating from the smaller piston surface A1.

The percussion device 1 is further equipped with a pilot control in the form of a pilot or control valve 14, which can assume either the illustrated (upper) blocking position or a (lower) open position.

Two surfaces, namely the smaller displacement surface V1 and the larger displacement surface V2, influence the position of the control valve 14. A pilot line 15 connects the larger surface to the interior of the work cylinder 2, with the opening or port 15*a* of the line 15 being behind the port 9*a* of the reversing line 9, seen in the direction of the work stroke (arrow 3*e*). The pilot line 15 is in turn connected on the discharge side to the pilot valve 14 via a pilot branch line 15*b* equipped with a baffle or choke 16.

A pilot resetting line 17*a* connects the smaller displacement surface V1 to the pressure line 8, and provides a path for the continuous exertion of the working pressure. The pilot valve 14 accordingly seeks to assume the open position (not shown) under the effect of the resetting force acting on the displacement surface V1.

On the intake side, a short-stroke line 18 connects the control valve by the port 18*a* to the interior of the work cylinder 2, while a pilot pressure line 17 connects the valve to the pressure line 8. The port 18*a* of the short-stroke line 18 is disposed behind the port 15*a* of the pilot line 15, again seen in the direction of the work stroke (arrow 3*e*). As already mentioned, on the discharge side, the pilot valve 14 is connected via the pilot branch line 15*b* to the pilot line 15, and is connected on the other side to the reversing line 9 for the control valve 5 by way of an additional line 19.

As can be seen in the schematic illustration, in the (upper) blocking position of the pilot valve 14, the pilot pressure line 17 is connected by way of the pilot branch line 15*b* to the pilot line 15, and thereby generates the adjusting force that may act in the direction of the blocking position, namely over the displacement surface V2. In the illustrated blocking position, the short-stroke line 18 and the additional line 19 are blocked in the direction of the pilot valve 14.

The (lower) open position of the pilot valve 14 is characterized in that the short-stroke line 18 is simultaneously connected to the pilot branch line 15*b* and the additional line 19, and the pilot pressure line 17 is blocked.

Depending on the position of the percussion piston 3 relative to the port 18*a,* either the pressure conditions in the lines 15, 15*b,* 19 and 18 or only the pressure conditions in the lines 15, 15*b* and 19 match. The latter scenario is the case if, as shown, the piston collar 3*b* blocks the port 18*a* of the short-stroke line against the interior of the work cylinder 2.

In the long-stroke mode, the percussion device operates as follows:

After the control valve 5 has been switched into the (left) work-stroke position, the percussion piston begins to move in the direction of the work stroke (arrow 3*e*) after the upper reversal point has been reached. The pilot valve 14 assumes the illustrated blocking position, and is held in this blocking position by the pilot pressure line 17 (because the working pressure is exerted onto both displacement surfaces V1 and V2).

When the percussion piston impacts the chisel 4, the reversing line 9 is relieved of pressure by way of the circumferential groove 3*c* and the return line 10. Consequently, the regulating distributor 5*a* of the control valve 5 switches into the illustrated return-stroke position, under the effect of the resetting force originating from the smaller control surface S1, thus initiating the return stroke of the percussion piston 3. If the chisel 4 does not penetrate the material to be reduced, the percussion piston 3 does not leave its provided, normal impact plane, so the port 15*a* of the pilot line 15 remains blocked by the piston collar 3*b*. The percussion piston 3 continues its return stroke until the reversing line 9 is connected by its port 9*a* and the front cylinder segment 2*b* to the pressure line 8.

Accordingly, the working pressure is exerted on the larger control surface S2. The regulating distributor 5*a* is therefore transferred into the (left) work-stroke position, so the regulator connects the rear cylinder segment 2*a* to the pressure line 8 by way of the control line 11 and initiates a new work stroke.

If the position of the impact plane shifts in the direction of the work stroke (arrow 3*e*) during the operation of the percussion device, the following processes take place:

After the control valve 5 has been switched into the work-stroke position and the pilot valve 14 has been switched into the blocking position, the percussion piston 3 first executes a work stroke. If the chisel 4 penetrates the material to be reduced, the percussion piston 3 also leaves its normal impact plane and follows the chisel 4. As a result of this shift, the port or opening 15*a* of the pilot line 15, which was initially blocked by the piston collar 3*b,* is now opened and pressure-relieved by way of the connection to the return line 10 produced by the annular groove 3*c*. Accordingly, the pilot valve 14 switches from its blocking position into the open position, which establishes a connection between the short-stroke line 18 and the additional line 19, which is in turn relieved of pressure by way of the reversing line 9, the annular groove 3*c* and the return line 10. This relief of pressure also causes the control valve 5 to switch into the return-stroke position, after which the percussion piston starts its return-stroke movement.

After a shorter stroke, the so-called short stroke, has been executed, the port 18*a* of the short-stroke line 18 is opened and connected to the pressure line 8 by way of the front cylinder segment 2*b*. By way of the short-stroke line 18, which is subjected to the working pressure, the lines 15*b* and 15 and the lines 19 and 9 are therefore subjected to pressure, with the interposing of the pilot valve 14. Consequently, before reaching the maximum possible stroke, the control valve 5 is switched into the (left) work-stroke position, and the work stroke is initiated again. At the same time, the larger displacement surface V2 of the pilot valve 14, which is subjected to the working pressure, effects the displacement of the valve into the illustrated blocking position, counter to the resetting force originating from the smaller displacement surface V1.

The described embodiment thus permits a reaction to the characteristics or behavior of the material to be reduced with each individual impact of the percussion piston. If the tool penetrates the material to be reduced, the percussion piston only executes a small stroke, so the energy of the individual impact is low. If the tool does not penetrate the material to be reduced, a large stroke utilizing the corresponding maximum individual-impact energy is executed.

Because no-load strokes of the percussion piston 3, and thus an unfavorable stressing of the percussion device, are unavoidable due to working conditions—despite the described automatic stroke switching—the percussion device is further equipped with a no-load-stroke protection mechanism, which switches automatically.

For this purpose, the interior of the work cylinder 2 additionally has a no-load-stroke port 20*a,* which, with the interposing of a no-load-stroke line 20, is disposed downstream of a switchable safety element in the form of an automatically-controlled 2/2-way valve 21. The intake side of this valve 21 is connected to the pressure line 8 by way of an intermediate line 22, and is therefore continuously subjected to the working pressure.

The 2/2-way valve can be switched between two end positions, namely the (left) inoperative position and the (right) active position, counter to the effect of a resetting mechanism 23 in the form of a spring element, and has a control surface 21*a,* which influences its position. Via a signal line 24 that is connected to the no-load-stroke line 20, this surface 21*a* can be subjected to a pressure level that forms a control signal such that the 2/2-way valve 21 is transferred from the illustrated inoperative position into its active position some time after the percussion device 1 has started up.

Whereas, in the illustrated inoperative position, the connection between the intermediate line 22 (and thus the pressure line 8) and the no-load-stroke line 20 is broken, in the (right) active position, the working pressure originating from the pressure line 8 is also present in the signal line 24, with the interposing of the no-load-stroke line 20, so the 2/2-way valve 21 maintains the active position once it has been assumed, due to the effect of the activation force originating from its control surface 21*a.*

As evidenced by the representation in FIG. 1, the no-load-stroke port 20*a* is separate from the port 18*a* of the short-stroke line 18. Accordingly, the no-load-stroke protection mechanism can become effective regardless of the conditions in the long-stroke or short-stroke mode, should the percussion piston 3 have overshot the normal impact position by a specified amount to assume a no-load-stroke position.

As mentioned above, the percussion piston 3 assumes the normal impact position in the drawing. Here, the front piston collar 3*b* having the smaller piston surface A1 closes the no-load-stroke port 20*a* in the direction of the interior of the work cylinder 2.

If the percussion piston has extended so far in the work-stroke direction (arrow 3*e*) that the front piston collar 3*b* no longer closes the no-load-stroke port 20*a,* the working pressure exerted on the port can act on the larger regulator surface S2 of the distributing regulator 5*a,* with the interposing of the annular groove 3*c* and the control line 9, so the control unit 5 is held in the (left) work-stroke position provided during the work stroke. To ensure that a sufficiently high pressure is present in the control line 9 during this time—despite an existing connection between the annular groove 3*c* and the return line 10—the return line 10 has a correspondingly selected discharge resistance, which is indicated by a throttle unit 10*b.* In other words, the control unit 5 is prevented from switching out of the work-stroke position into the (right) return-stroke position under the aforementioned conditions, with the effect of the working pressure originating from the no-load-stroke port 20*a,* thereby halting the percussion piston 3.

The no-load-stroke protection mechanism can easily be switched to be inactive as follows: The 2/2-way valve 21 is transferred into its (left) inoperative position, namely through the cutoff of the working pressure originating from the pressure line 8. As a result of this cutoff procedure, the pressure level acting on the control surface 21*a* drops, and the 2/2-way valve 21 switches into the illustrated inoperative position under the effect of the spring element 23.

Of course, the 2/2-way valve 21 can also be reset hydraulically. That is a hydraulic force that acts in the direction of the inoperative position is generated while the working pressure is exerted onto the percussion device.

Figure 2:
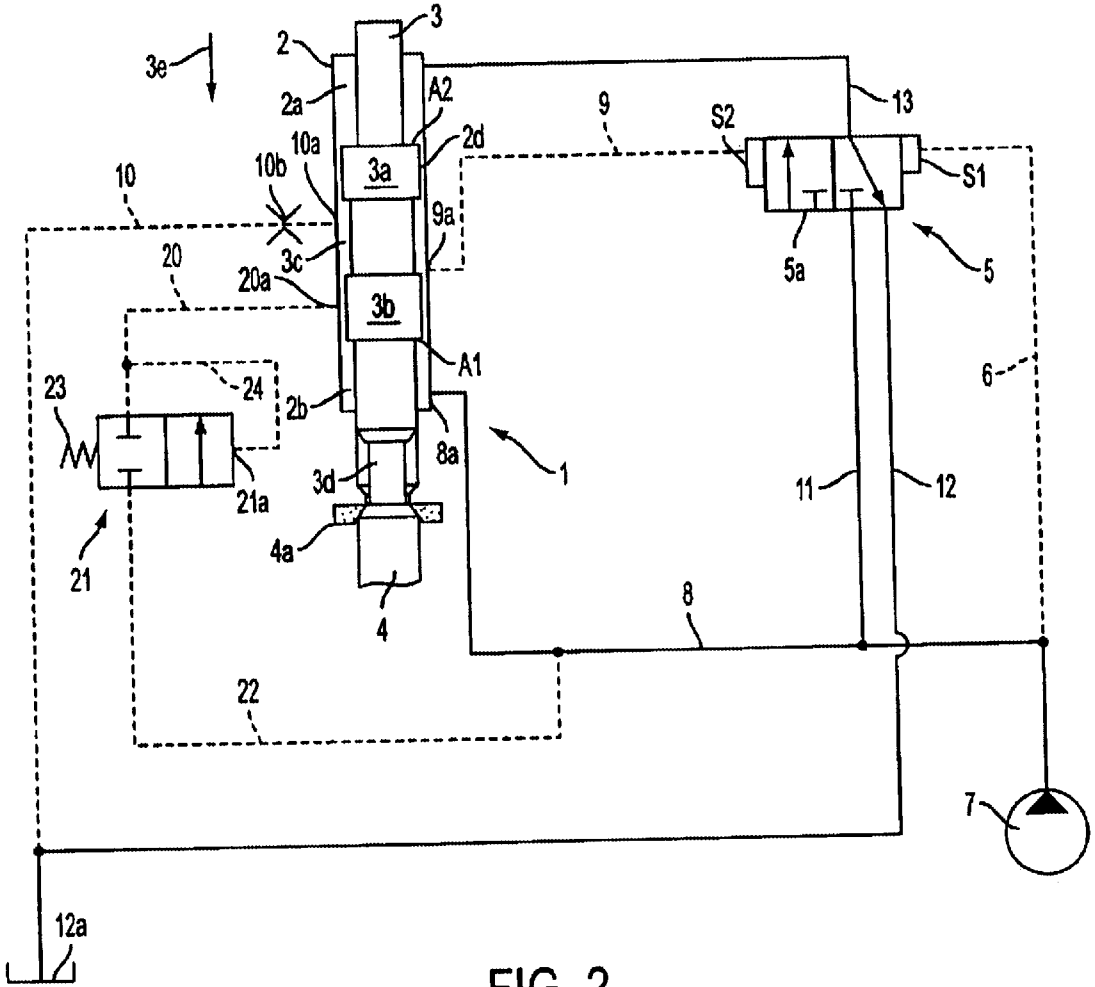
FIG. 2 shows the circuit diagram of a percussion device that has no pilot control (corresponding to FIG. 1) that cooperates with the control unit.
Figure 3:
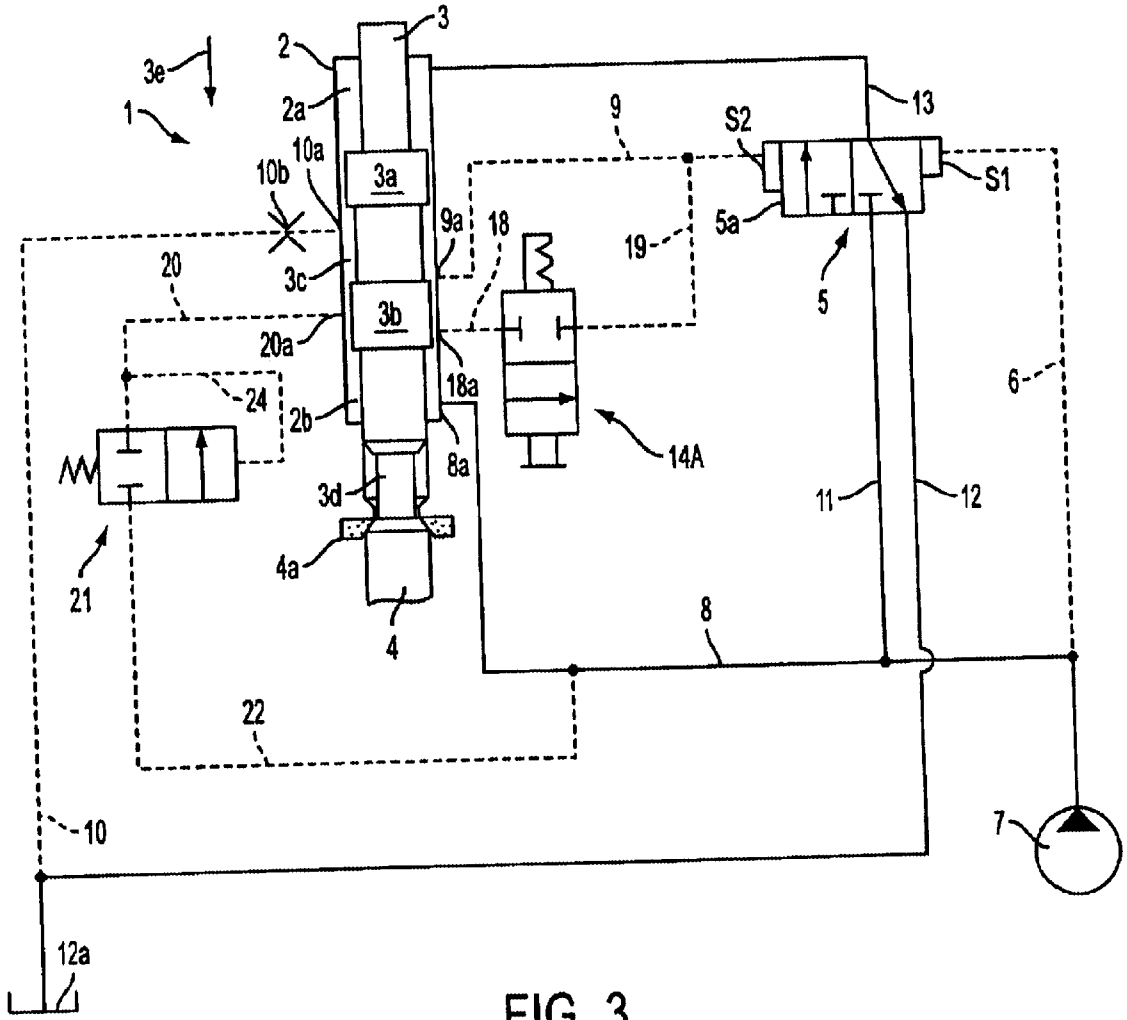
FIG. 3 shows the circuit diagram of a percussion device having a reversing valve that can be operated arbitrarily for influencing the stroke of the percussion piston.

Instead of the above-described embodiment according to FIG. 1, the no-load-stroke protection mechanism (2/2-way valve 21) can also be used in connection with other types of percussion devices, such as the embodiments of the percussion device shown in FIGS. 2 and 3.

The embodiment according to FIG. 2 differs from the embodiment according to FIG. 1 in that there is no automatic pilot device in the form of a pilot valve 14. Accordingly, in this embodiment, the lines 15, 15*b,* 17, 17*a,* 18 and 19, as well as the ports 15*a* and 18*a* and the baffle 16 associated with the line 15*b,* are omitted. Also in this embodiment, the distributing regulator 5*a* of the control valve 5 either assumes the illustrated return-stroke position (right) or the work-stroke position (left), depending on the pressure conditions in the reversing line 9.

If the 2/2-way valve is in the (right) active position, the control line 9 is subjected to the working pressure by way of the no-load-stroke line 20 as the piston collar 3*b* passes in the direction of the work stroke (arrow 3*e*), so the control unit 5 is held in the work-stroke position it assumed during the work stroke (as already explained in connection with FIG. 1). If the return line 10 has an appropriately selected discharge resistance (throttle unit 10*b*), this assures the buildup of a sufficiently high pressure in the control line 9.

In the embodiment according to FIG. 3, a reversing valve 14A is associated with the control unit 5. This valve 14*a* can arbitrarily (preferably remotely) be moved between two end positions, namely the illustrated blocking position and an open position. A short-stroke line 18 and the port 18*a* connect the reversing valve 14A to the interior of the work cylinder 2. An additional line 19 connects the valve to the reversing line 9.

In the illustrated blocking position, the reversing valve 14A exerts no influence on the position of the distributing regulator 5*a* of the control unit 5. In contrast, if the reversing valve 14A assumes the (lower) open position, depending on the position of the percussion piston 3 inside the work cylinder 2, a connection can be established between the cylinder interior and the reversing line 9, which may shift the distributing regulator 5*a* into the (left) work-stroke position.

As soon as the piston collar 3*b* opens the port 18*a* of the short-stroke line 18 during the return-stroke movement of the percussion piston 3, the working pressure acts on the port 18*a* by way of the front cylinder segment 2*b,* so the distributing regulator 5 can be displaced to the right due to the effect of the larger regulator surface S2, which is now under pressure, and thus prematurely initiates a new movement of the percussion piston 3 in the direction of the work stroke (arrow 3*e*). The reversing valve 14A thus allows for arbitrarily influencing the function of the percussion device 1 such that the device may operate temporarily in the short-stroke mode.

In this embodiment as well, the effect of the no-load-stroke protection mechanism (2/2-way valve 21) is independent of the position of the reversing valve 14A.

The effect of the 2/2-way valve 21 assuming the (right) active position allows a sufficiently high pressure to be exerted onto the reversing line 9 after the piston collar 3*b* of the percussion piston 3 moving in the work-stroke direction has opened the port 20*a* of the no-load-stroke line 20. The pressure conditions that then dominate can prevent the distributing regulator 5*a* from assuming the (illustrated) return-stroke position, so the percussion device 1 is halted.

As can be seen in the aforementioned embodiments, the 2/2-way valve 21 that forms the safety element is initially subjected to the working pressure when the percussion device 1 starts up, and assumes the illustrated (left) inoperative position due to the effect of its resetting mechanism 23. It is thus switched to be ineffective. Some time after the percussion device has started up, the 2/2-way valve 21 is transferred into its active position when the front piston collar 3*b* opens the no-load-stroke port 20*a* over the course of the return-stroke movement of the percussion piston 3, and connects the port 20*a* to the pressure line 8 via the front cylinder segment 2*b.* After the switch into the (right) active position, this position is maintained as long as the lines 8, 22, 20 and 24 are subjected to the working pressure.

Figure 4:
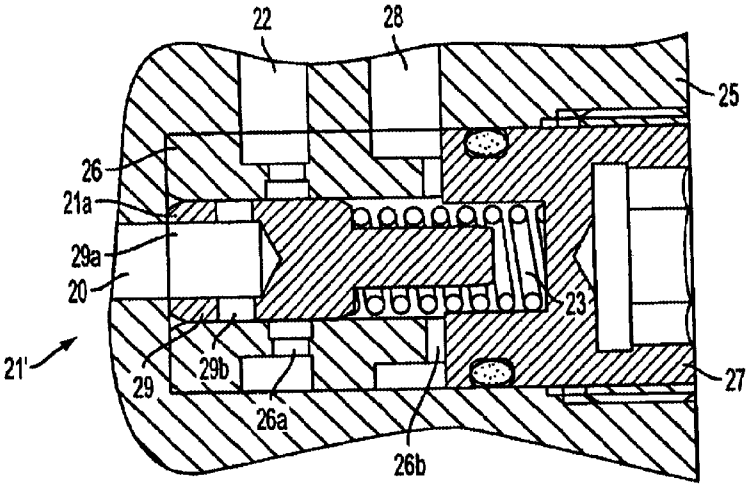
FIG. 4 illustrates a safety element in the form of a 2/2-way valve, shown schematically in a partial section.

The 2/2-way valve 21' illustrated in FIG. 4 has a hollow cylinder 26 inside a housing 25, the cylinder being provided with a plurality of transverse bores 26*a* and grooves 26*b.* The hollow cylinder is fixed relative to the housing 25 by a threaded pin 27 that is screwed to the housing, and is sealed against the environment.

The transverse bores 26*a* and grooves 26*b* connect the hollow cylinder 26 to the intermediate line 22 subjected to the working pressure, or to a pressure-relieved leakage line 28. The latter can also be connected to the return line 10. A valve piston 29, which is supported on the right side against the prestressed spring element 23 acting as a resetting mechanism, is guided to move inside the hollow cylinder 26, and, due to the effect of the spring, rests with its control surface 21*a* against the housing 25 in the illustrated inoperative position.

On the left side of the drawing, the valve piston 29 has a center bore 29*a,* which cooperates with the no-load-stroke line 20 and transverse bores 29*b* connected to this bore. Accordingly, the 2/2-way valve 21' differs from the embodiments according to FIGS. 1 through 3 in that the control surface 21*a* is connected directly to the no-load-stroke line 20, so the signal line 24 shown in FIGS. 1 through 3 is omitted.

If the working pressure is present in the no-load-stroke line 20, and thus at the control surface 21*a,* the valve piston 29 is displaced—counter to the resetting force originating from the spring element 23—to the right in the drawing, so the bores 29*a,* 29*b* and 26*a* establish a connection between the lines 20 and 22. The 2/2-way valve 21' thus assumes its active position explained in connection with FIGS. 1 through 3. However, the 2/2-way valve 21' can easily be switched back into its inoperative position if the pressure level present in the no-load-stroke line 20 drops due to the shutoff of the percussion device.

Figure 5:
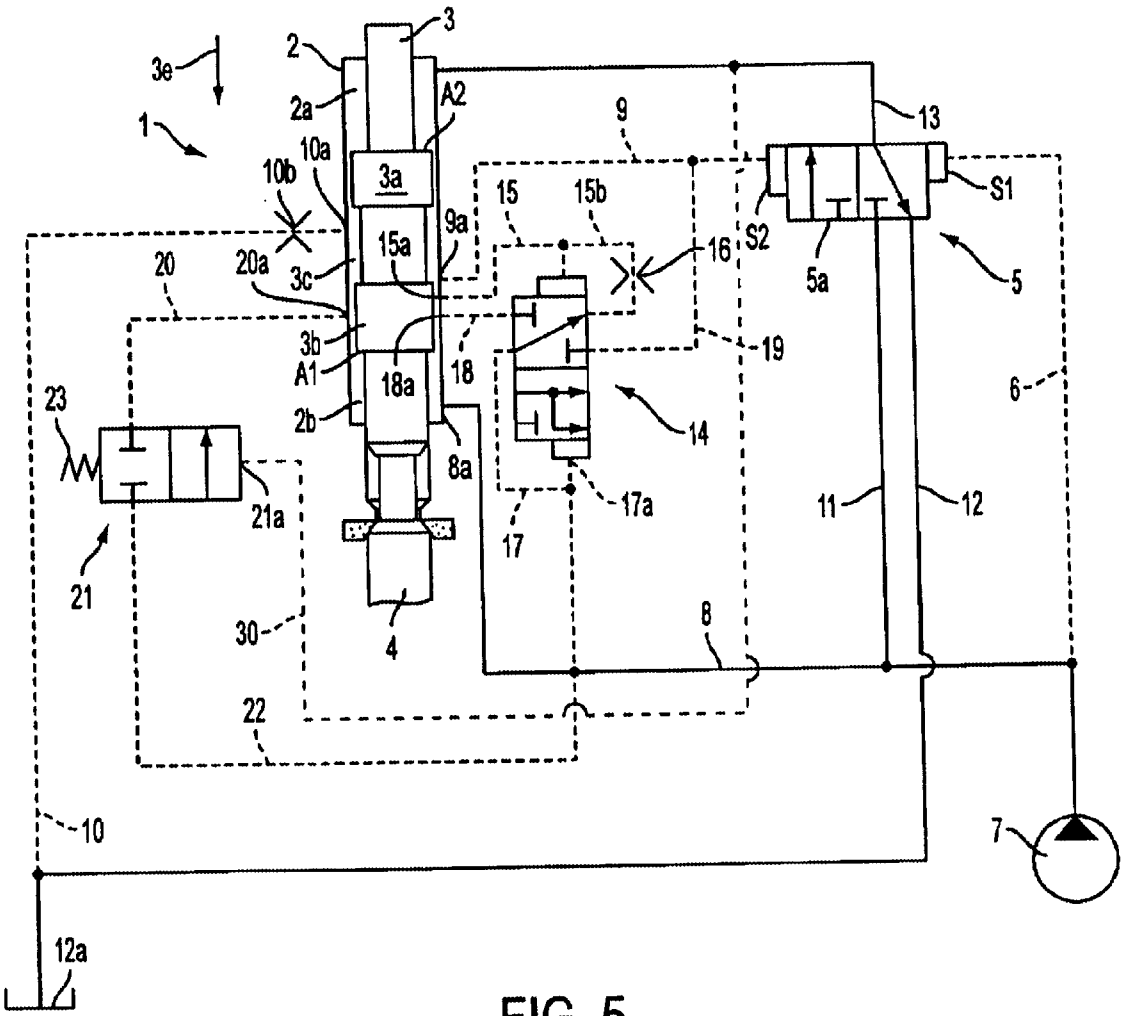
FIG. 5 shows the circuit diagram of a percussion device having an automatic stroke-switching mechanism and a safety element whose signal line is connected to the alternating-pressure line of the percussion device.

The embodiment illustrated in FIG. 5 differs from the embodiment according to FIG. 1 in that the 2/2-way valve 21 serving as a safety element is connected via a signal line 30, which acts on the control surface 21*a,* to the alternating-pressure line 13. This line is connected in turn to the rear cylinder segment 2*a,* and subjects the larger piston surface A2 to the working pressure as long as the control valve 5 does assume the (left) work-stroke position, not shown, and a connection is therefore present between the lines 13 and 8.

In this embodiment, some time after the percussion device 1 has started up, the 2/2-way valve 21 is transferred for the first time into its (right) active position, not shown, as soon as the control valve 5 has assumed its (left) work-stroke position and the signal line 30 is likewise subjected to the working pressure via the alternating-pressure line 13. Accordingly, the 2/2-way valve 21 is displaced to the left in the drawing, due to the effect of the activation force exerted onto the control surface 21*a.* Consequently, a connection is established between the lines 22 and 20. If no additional measures are taken, the 2/2-way valve 21 is basically only held in its active position as long as the working pressure is present in the alternating-pressure line 13.

The function of the 2/2-way valve 21 as a no-load-stroke protection mechanism is not compromised, however, because the valve is at least always switched to be active if the percussion piston 3 is driven in the direction of the work stroke and no-load strokes could occur.

The suitable structuring of the 2/2-way valve 21 can ensure that the valve maintains the active position once it has been assumed—even if the pressure exerted onto the signal line 30 during the return-stroke movement of the percussion piston 3 is insufficient, until the working pressure is again present in the alternating-pressure line 13 and initiates the activation force by way of the control surface 21*a.*

Figure 6:
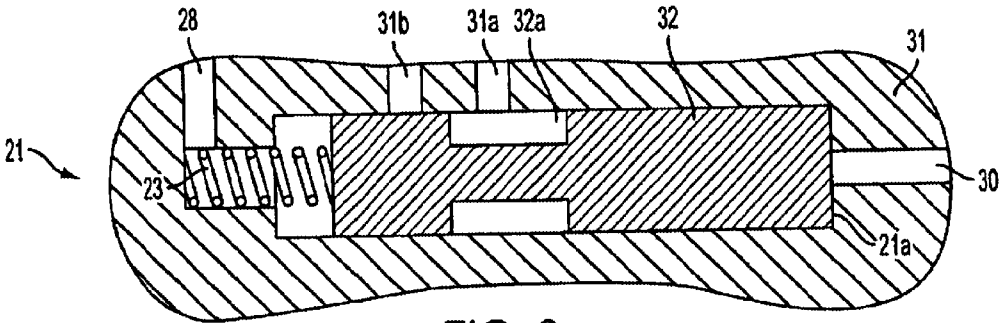
FIG. 6 illustrates a different embodiment of a safety element in the form of a 2/2-way valve, shown schematically in a partial section.

FIG. 6 illustrates an especially simple embodiment of the 2/2-way valve 21 that was explained in conjunction with embodiment of FIG. 5.

Here, a valve piston 32, which is provided with an circumferential annular groove 32*a,* is guided to move longitudinally inside a housing 31, and is supported on the left side against a spring element 23 that is likewise disposed in the housing 31. The region occupied by the spring element 23 is again kept relieved from pressure by a leakage line 28.

In the illustrated inoperative position, the valve piston 32 rests with its control surface 21*a,* which faces the signal line 30, against the housing 31. The housing has two spaced bores 31*a* and 31*b,* which are connected to the intermediate line 22 or the no-load-stroke line 20 (see, for example, FIG. 1). With respect to the valve piston 32, the bore 31*a* is disposed such that it is connected to the annular groove 32*a* in the illustrated inoperative position, while the valve piston blocks the bore 31*b.*

If the working pressure is present in the signal line 30, the valve piston 32 is displaced to the left into the active position, counter to the resetting effect of the spring element 23, so that the annular groove 32*a* effects a connection between the bores 31*a* and 31*b*—and thus between the lines 22 and 20 (see, for example, FIG. 5). The 2/2-way valve 21 shown in FIG. 6 is thus switched to be effective at least as long as the working pressure is present in the signal line 30, thereby driving the percussion piston 3 in the direction of the work stroke (arrow 3*e*).

Figure 7:
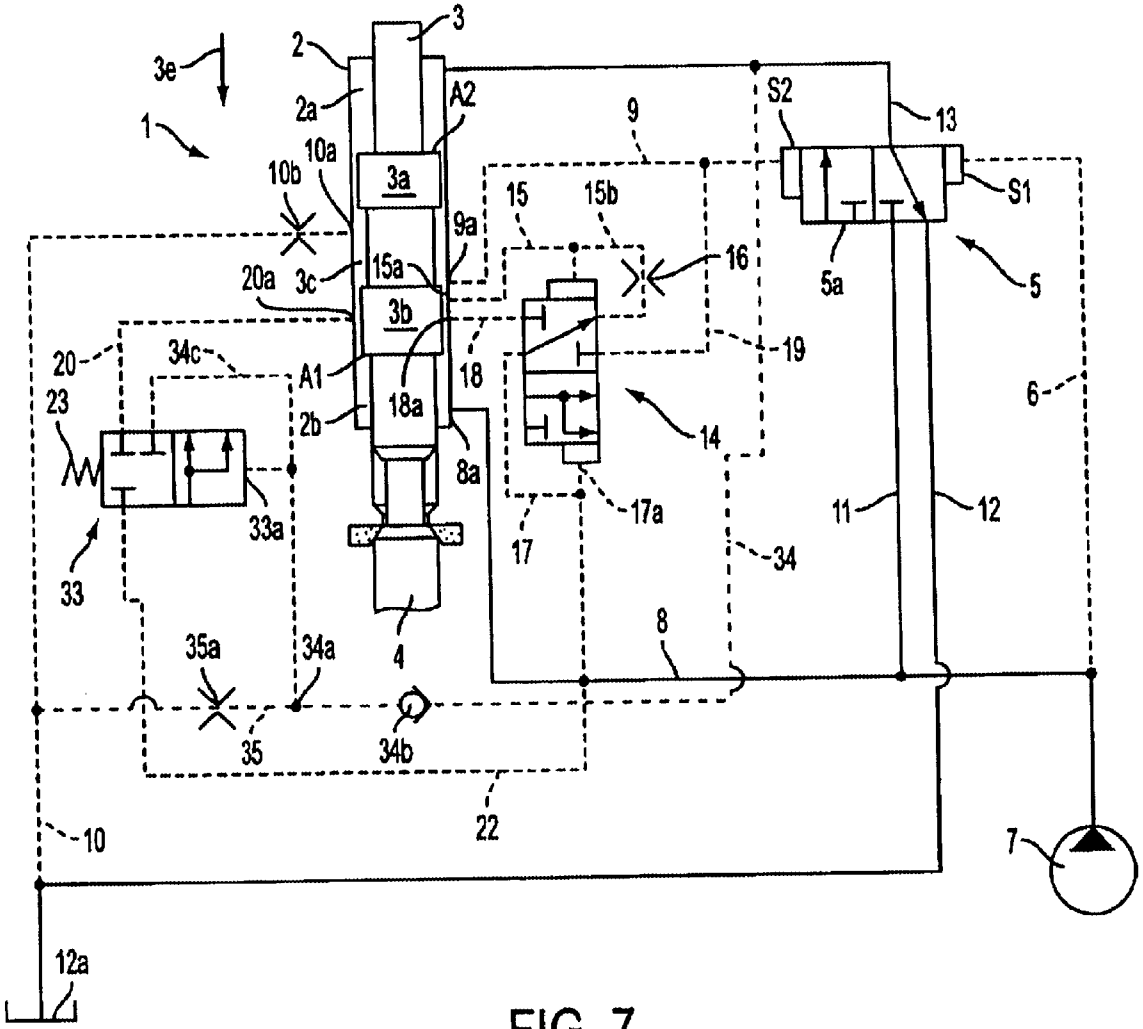
FIG. 7 shows the circuit diagram of a percussion device having an automatic stroke-switching mechanism and a safety device in the form of a 3/2-way valve whose signal line is connected to the alternating-pressure line of the percussion device.

In the embodiment of the invention shown in FIG. 7, the safety element is embodied as a 3/2-way valve 33, and is connected via a signal line 34 that acts on the control surface 33*a* to the above-described alternating-pressure line 13.

On the intake side, the 3/2-way valve is connected to the intermediate line 22, which in turn changes over to the pressure line 8. On the discharge side, the 3/2-way valve 33 is connected to the no-load-stroke line 20, and to the signal line 34 via a guidance part 34*c*. The signal line 34 is connected to a throttle line 35, in addition to the 3/2-way valve 33. With the interposition of a throttle element 35*a*, the throttle line 35 changes over to the return line 10. Seen from the alternating-pressure line 13, the connecting point 34*a* between the lines 34 and 35 is downstream of a spring-loaded check valve 34*b*, which blocks the signal line 34 in the direction of the alternating-pressure line 13.

In the illustrated (left) inoperative position, the connection between the lines 22 and 20 is broken. That is, only the control surface 33*a* is connected to the signal line 34. In the (right) active position of the 3/2-way valve 33, the no-load-stroke line 20 and the signal line 34 are connected to the intermediate line 22 by way of their guidance part 34*c*.

If the alternating-pressure line 13 is subjected to the working pressure, the activation force acting on the control surface 33*a* of the 3/2-way valve 33 can transfer the valve into the (right) active position, counter to the resetting action of the spring element 23. As a result, the lines 20, 34*c* are correspondingly acted upon, and the 3/2-way valve 33 is thus held in the active position it has initially assumed, regardless of subsequent changes in the pressure level in the alternating-pressure line 13. The check valve 34*b* therefore blocks the signal line 34 in the direction of the alternating-pressure line 13, while the throttle element 35*a* maintains the present pressure level in the in the guidance part 34*c* and at the control surface 33*a*.

If the percussion device 1 is shut down through the cutoff of the working pressure, the throttle element 35*a* can relieve the guidance part or line 34*c* and the control surface 33*a* of pressure, so the 3/2-way valve 33 is switched back into its illustrated inoperative position.

The discussed 3/2-way valve 33 is thus modified and connected such that, through the maintaining of the working pressure, the valve is transferred into its active position as a function of the pressure level in the signal line 34, and maintains this position as long as the percussion device 1 is in the operating mode.

Some time after the percussion device has started up, the no-load-stroke protection mechanism is activated through the exertion of the working pressure onto the alternating-pressure line 13 after the control valve 5 has been switched into the (left) work-stroke position, and thus drives the percussion piston 3 in the direction of the work stroke (arrow 3*e*). Unlike in the above-described embodiment, the function of the 3/2-way valve 33 can be dependent on the connection of the signal line to the spring-loaded check valve 34*b* for the connection to other percussion-device lines. In the embodiment according to FIG. 8, the signal line 34 is connected to the reversing line 9, thereby influencing the position of the control valve 5. In this instance, the 3/2-way valve 33 switches into the (right) active position if the reversing line 9 is subjected to the working pressure, and the control valve 5 is therefore transferred into its (left) work-stroke position for initiating the work-stroke movement of the percussion piston 3.

Figure 9:
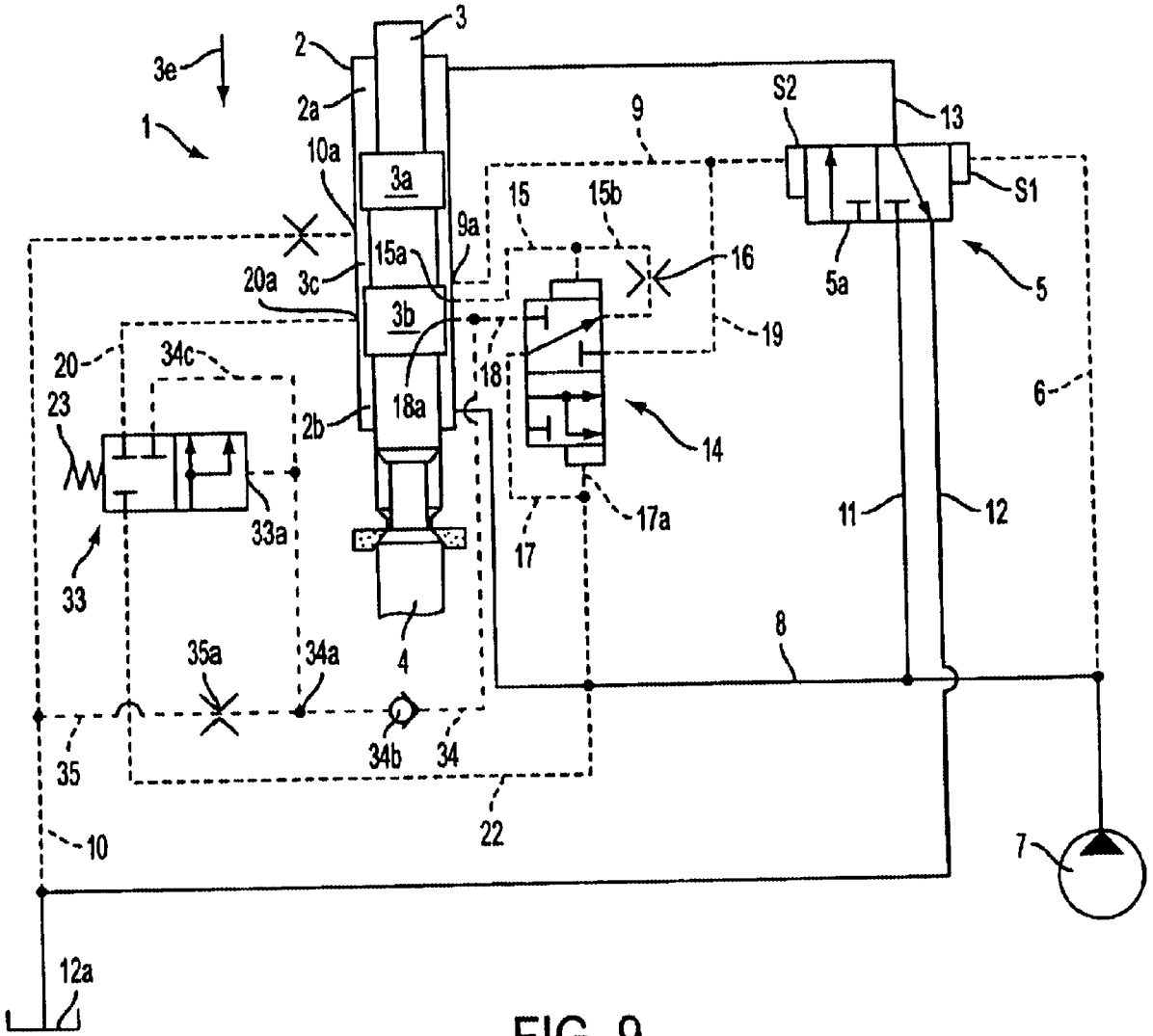
FIG. 9 shows the circuit diagram of a percussion device having an automatic stroke-switching mechanism and a safety element in the form of a 3/2-way valve whose signal line is connected to the short-stroke line of the percussion device.

In the embodiment according to FIG. 9, the signal line 34 is connected to the spring-loaded check valve 34*b*, then connected to the short-stroke line 18. Accordingly, the 3/2-way valve 33 is transferred into its (right) active position as soon as the working pressure is exerted on the short-stroke line 18 for the first time.

Figure 10:
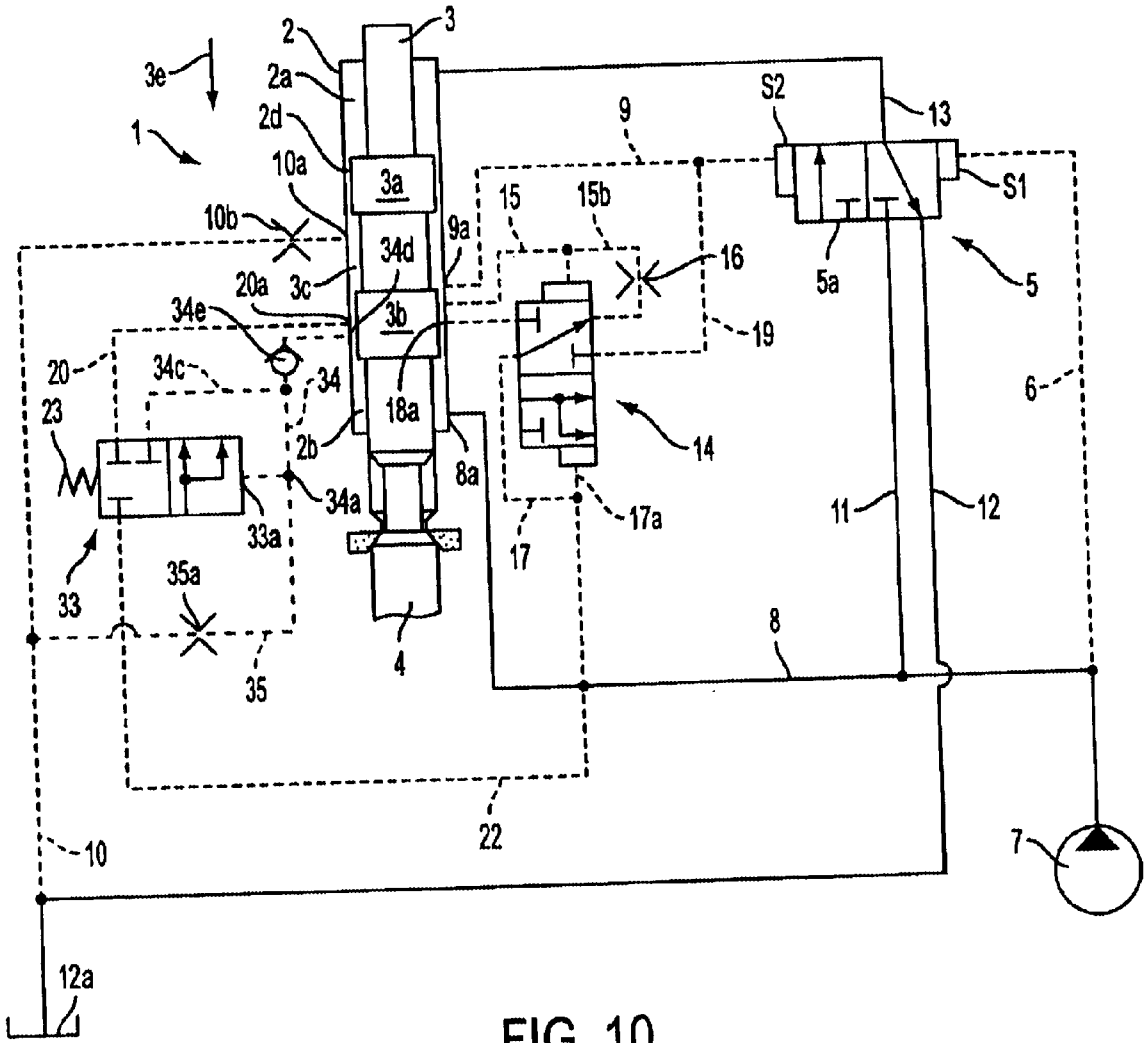
FIG. 10 is a circuit diagram of a percussion device having an automatic stroke-switching mechanism and a safety element in the form of a 3/2-way valve whose signal line is connected to the interior of the work cylinder outside of the no-load-stroke mouth.

The illustration according to FIG. 10 depicts an embodiment of the subject of the invention in which the signal line 34 associated with the 3/2-way valve 33 is connected to the interior of the work cylinder 2 by way of an additional bore 34*d*. The additional bore 34*d* is disposed such that it terminates into the interior in front of the no-load-stroke port 20*a*, seen in the direction of the return stroke of the percussion piston 3. A spring-loaded check valve 34*e* is disposed downstream of the guidance part 34*c* of the signal line 34, in the direction of the additional bore 34*d*, and blocks in the direction of the additional bore.

Adjoining the segment of the signal line 34 that allows the control surface 33*a* to be acted upon, the signal line 34 changes over to the above-described throttle line 35 at the connecting point 34*a*. The check valve 34*e* serves in blocking the upstream segments of the signal line 34 against the interior of the work cylinder 2 in the event that the 3/2-way valve 33 has been transferred into the (right) active position and the working pressure is present in the guidance part 34*c* and at the control surface 33*a*. The aforementioned position of the additional bore 34*d* causes the 3/2-way valve 33 to switch into the active position before the front piston collar 3*b* opens the no-load-stroke mouth 20*a* of the no-load-stroke line 20.

Unlike in the above-described embodiments, the subject of the invention can also be embodied such that the segment of the signal line 34 connected to the control surface 33*a* of the 3/2-way valve 33 so as to permit a flow is connected to a signal source that either continuously or intermittently supplies a limited control volume to the control surface per time unit, or in increments, after the percussion device 1 has started up. Under the influence of this volume, the 3/2-way valve 33 is transferred into the active position some time after the percussion device has started up.

Figure 11:
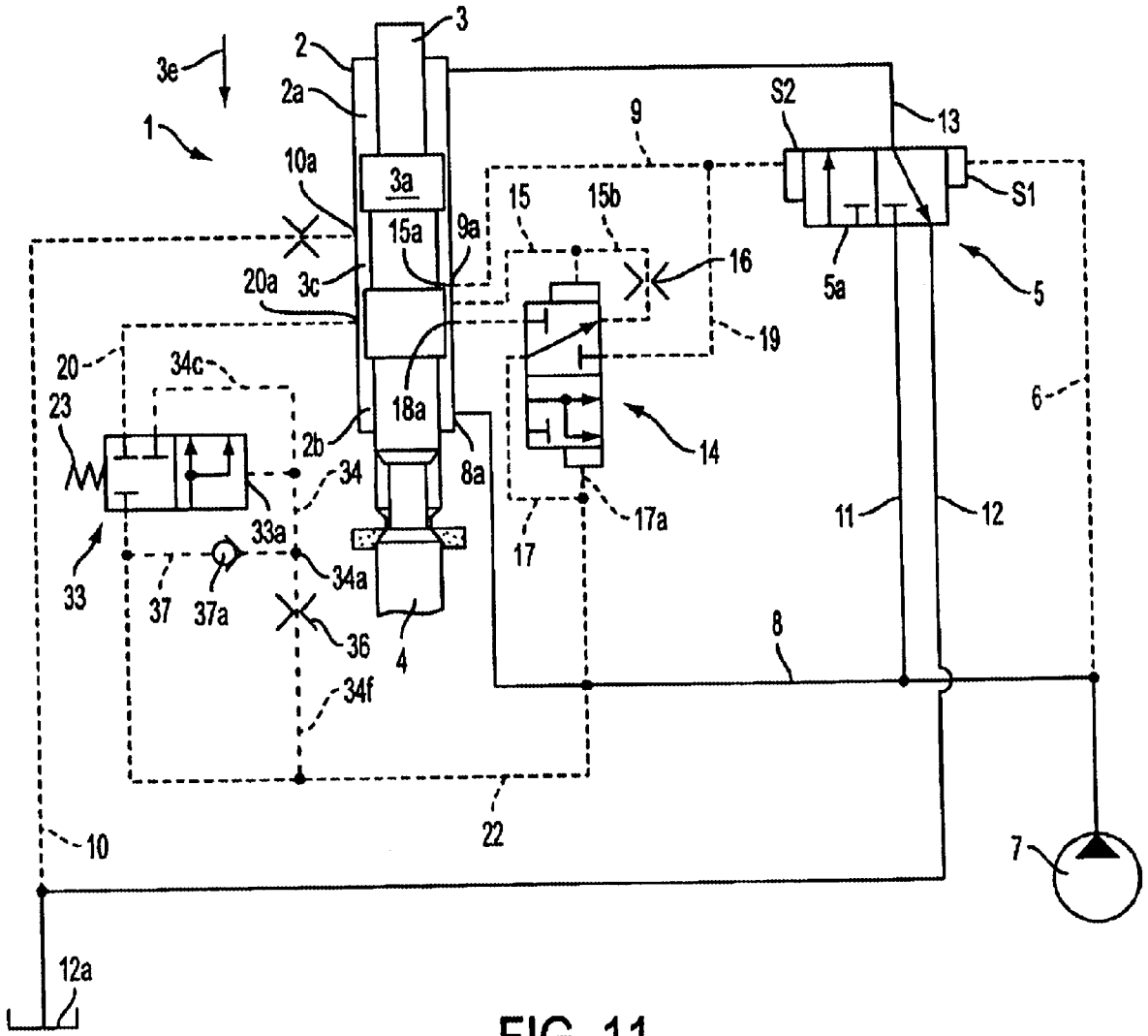
FIG. 11 is a circuit diagram of a percussion device having an automatic stroke-switching mechanism and a safety element in the form of a 3/2-way valve whose signal line is connected to the pressure line with the interposing of a throttle element, and additionally has a discharge line with a check valve.

For this purpose, in the embodiment illustrated in FIG. 11, the signal line 34 is connected, via a branch line 34*f* that is equipped with a throttle element 36, to the intermediate line 34*f* subjected to the working pressure. The connecting point 34*a* between the signal line 34 and the branch line 34*f* is also connected to a discharge line 37, which is likewise connected to the intermediate line 22 and is equipped with a spring-loaded check valve 37*a*. The latter blocks the discharge line 37 in the direction of the signal line 34 and the branch line 34*f*.

After the percussion device 1 has started up, the signal line 34 is supplied with a limited control volume per time unit, as effected by the throttle element 36. Consequently, the control volume acting on the control surface 33*a* increases continuously, and gradually transfers the 3/2-way valve 33 into the (right) active position. The valve 33 maintains this position as long as the percussion device 1 is in the operating mode, i.e., is subjected to the working pressure.

The discharge line 37 serves in relieving the pressure in the signal line as soon as possible after the working pressure has been cut off: In the process, the control surface 33*a* expels fluid in the direction of the intermediate line 22, due to the effect of the resetting force originating from the spring element 23, so the 3/2-way valve 33 can re-assume the illustrated inoperative position.

Unlike in the embodiment according to FIG. 11, the subject of the invention can also be embodied such that the discharge line 37 and the check valve 37*a* are omitted. In this case, the control surface 33*a* can expel fluid in the direction of the branch line 34*f* and the intermediate line 22 in a corresponding manner, so the 3/2-way valve 33 can switch again into its illustrated inoperative position.

Figure 12:
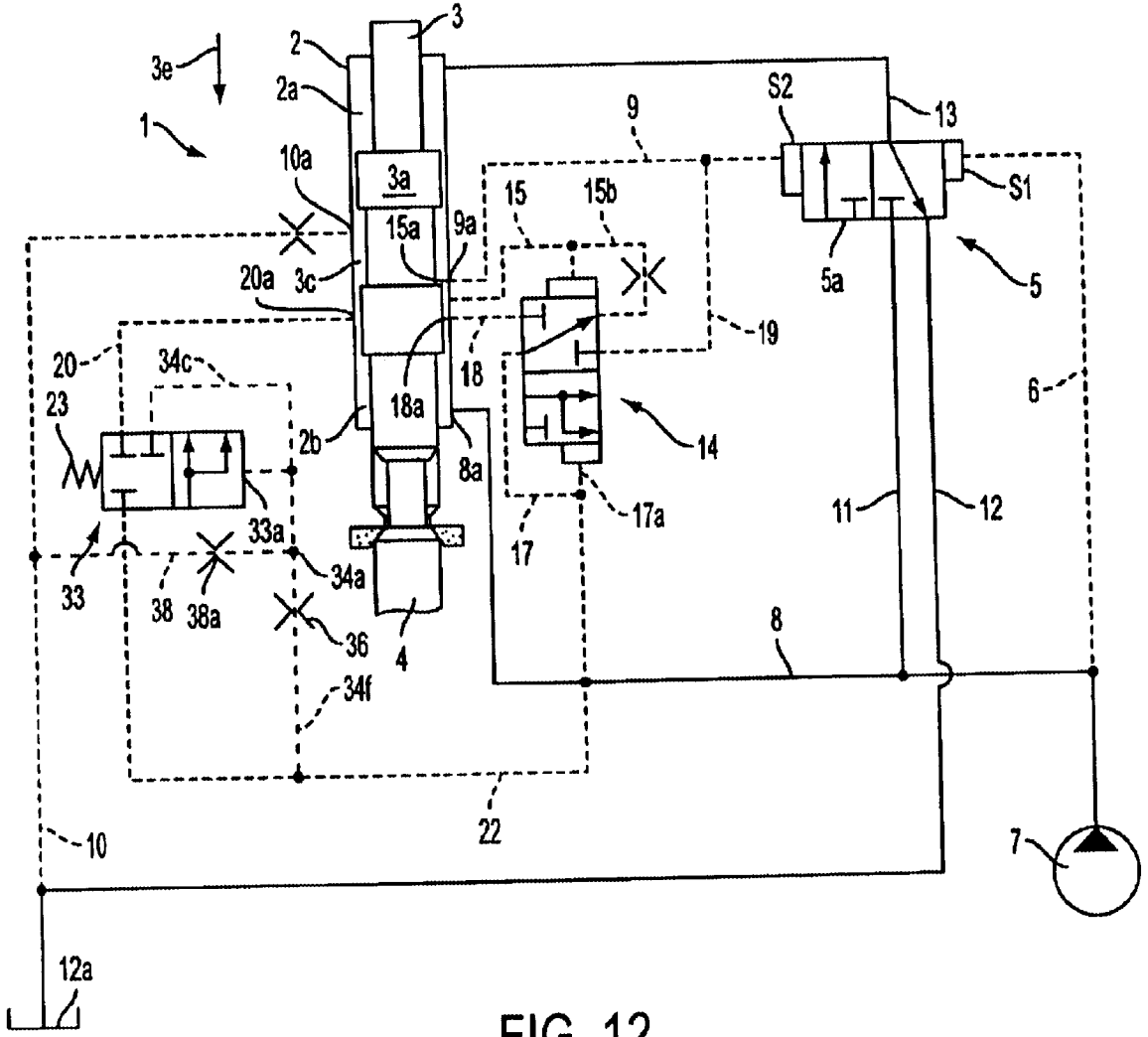
FIG. 12 is a the circuit diagram of a percussion device having an automatic stroke-switching mechanism and a safety element in the form of a 3/2-way valve whose signal line is connected to the pressure line with the interposing of a throttle element, and additionally includes a throttle line equipped with a throttle element.

The embodiment according to FIG. 12 corresponds in function to the embodiment according to FIG. 11, except that the connecting point 34*a* between the control line 34*c* and the branch line 34*f* is connected to a throttle line 38, which is likewise equipped with a throttle element 38*a* and terminates in turn into the return line 10. The throttle element 36 of the branch line 34*f* has a larger flow cross-section than the throttle element 38*a* of the throttle line 38. Accordingly, a limited control volume is supplied to the control surface 33*a* per time unit by way of the signal line 34. This corresponds to the difference between the volume introduced through the throttle element 36 and the volume carried off by way of the throttle element 38*a*.

This embodiment also permits the gradual buildup of a control volume in the signal line 34, following the connection to the throttle element 36, as a function of the on period of the percussion device 1. This volume, which continuously displaces the control surface 33*a* per time unit, and thus finally switches the 3/2-way valve 33 counter to the effect of the spring element 23, into the (right) active position, which the valve maintains as long as the working pressure exerted onto the percussion device is present in the intermediate line 22.

Figure 13:
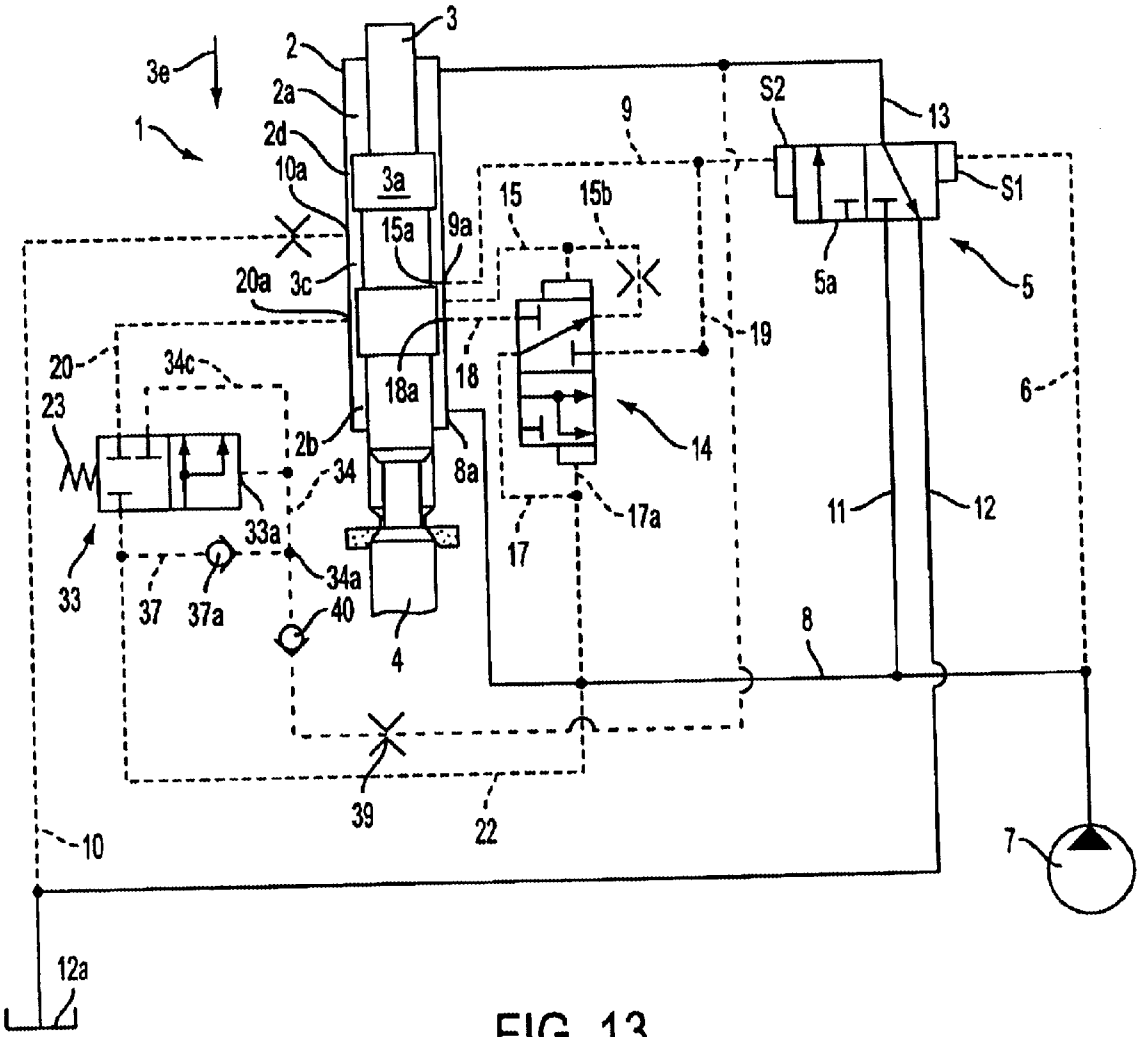
FIG. 13 is a circuit diagram of a percussion device having an automatic stroke-switching mechanism and a safety element in the form of a 3/2-way valve whose signal line is connected to the alternating pressure line of the percussion device with the interposing of a check valve and a throttle element, and additionally has a discharge line with a check valve.

As shown in FIG. 13, the percussion device 1 can also be configured such that the segment of the signal line 34 that is connected to the control surface 33*a* so as to permit a flow is connected to a percussion-device line, with the interposition of a throttle element 39. Depending on the operating mode of the percussion device, the working pressure is only present temporarily in this line. Consequently, the control surface 33*a* is displaced in increments, starting from the illustrated inoperative position, over the course of numerous consecutive movement cycles of the percussion piston 3 until the 3/2-way valve 33 has reached the (right) active position.

In the embodiment discussed here, the signal line is connected to the alternating-pressure line 13 that is temporarily subjected to the working pressure, and has, in addition to the throttle element 39, a spring-loaded check valve 40, which blocks in the direction of the alternating-pressure line 13. Regardless of the relative position of the components 39 and 40, the discharge line 37 that was explained above in connection with FIG. 11, and terminates into the intermediate line 22, is disposed downstream of the check valve 40. The connecting point between the lines 34 and 37 is, again, represented by 34*a*.

In the above-described embodiment, the control surface 33*a* is supplied with a limited control volume as long as the working pressure is present in the alternating-pressure line 13. Here, the check valve 37*a* of the discharge line 37 assumes the blocking position due to the effect of the working pressure dominating in the intermediate line 22. If a sufficient control volume is supplied to the control surface 33*a* over the course of numerous consecutive work cycles, the 3/2-way valve 33 ultimately switches into the (right) active position. As a result, the no-load-stroke line 20 and the signal line 34 are also subjected to the working pressure, and the check valve 40 blocks in the direction of the alternating-pressure line 13. Accordingly, the 3/2-way valve 33 then remains in the active position it has assumed once as long as the working pressure is present in the intermediate line 22.

After the working pressure has been cut off, the 3/2-way valve 33 is relieved of pressure by way of the discharge line 37. As a result, the 3/2-way valve 33 is returned to the illustrated (left) inoperative position due to the effect of the spring element 23.

Figure 8:
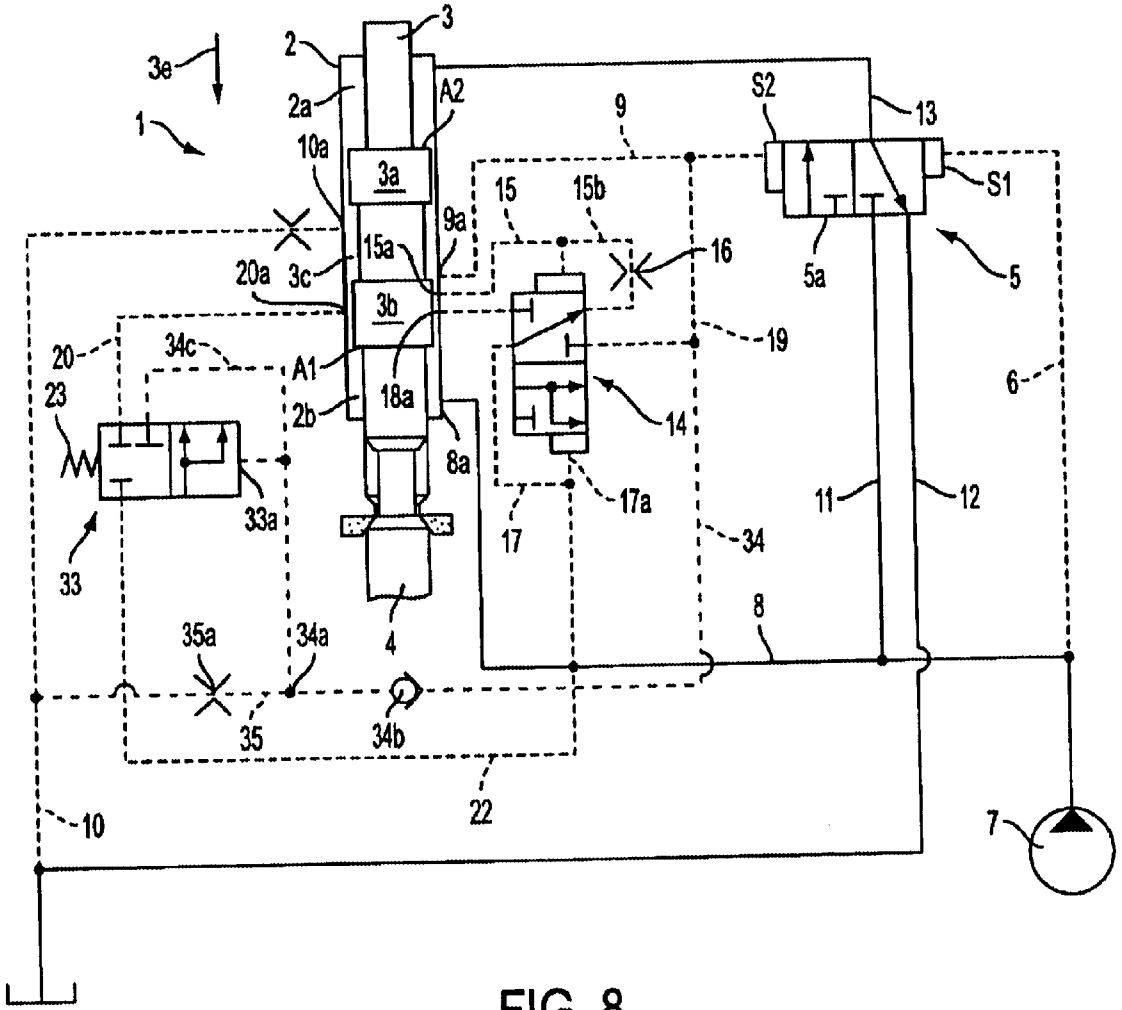

The latter embodiment can be modified, provided that there are no other changes, such that the signal line 34 is connected to the reversing line 9, corresponding to FIG. 8, or—borrowing from FIG. 9—to the short-stroke line 18.

These percussion-device lines are also only temporarily subjected to the working pressure, and can be used, in cooperation with the correspondingly-equipped lines 34 and 37, for building up the control volume that is required for displacing the control surface 33*a,* and thus for switching the 3/2-way valve 33, in stages over the course of numerous consecutive movement cycles of the percussion piston 3.

As an alternative, the subject of the invention can also be embodied such that the signal line 34 is connected directly to the rear cylinder segment 2*a,* that is, without the interposition of the alternating-pressure line 13.

Figure 14:
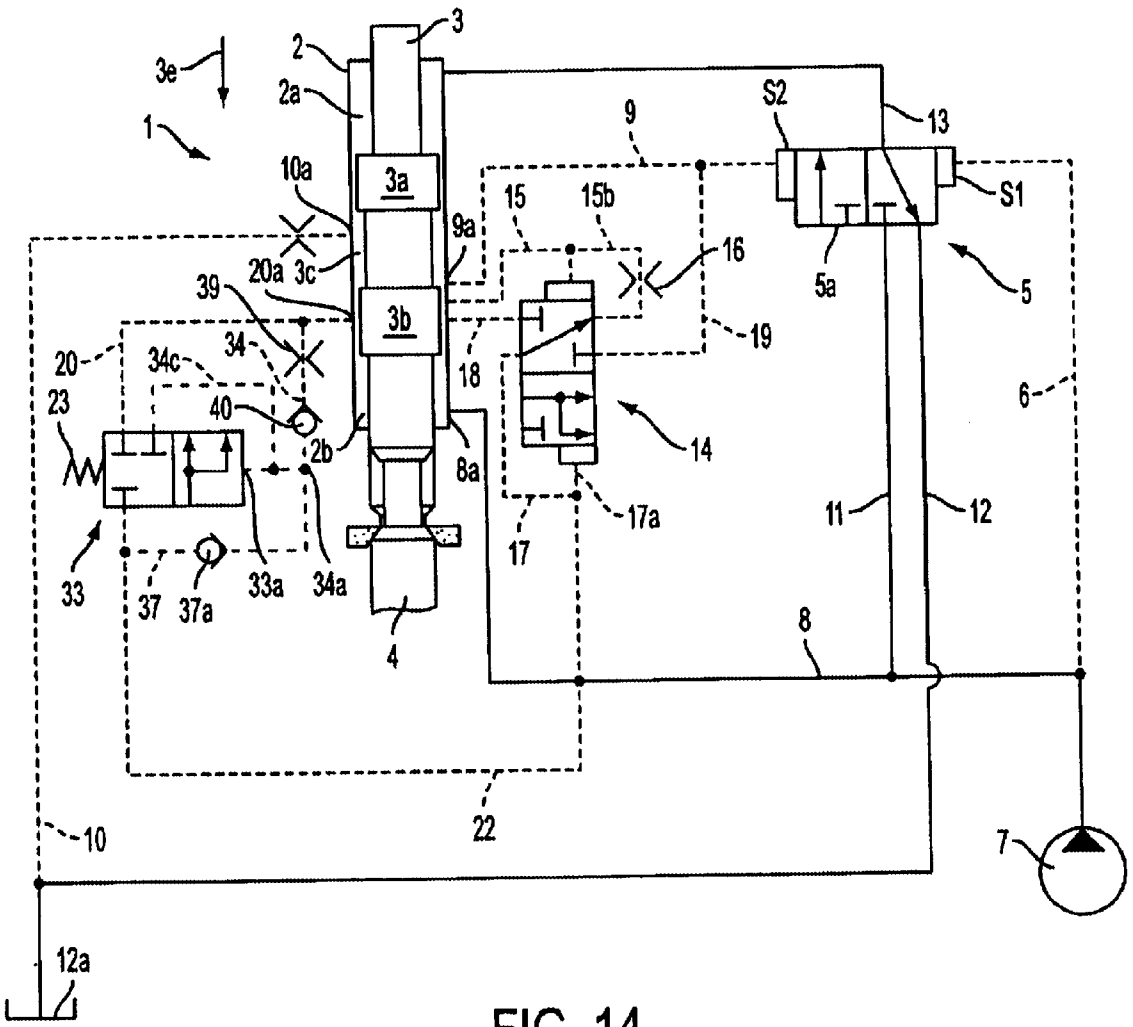
FIG. 14 is a circuit diagram of a percussion device having an automatic stroke-switching mechanism and a safety element in the form of a 3/2-way valve whose signal line is connected to the no-load-stroke line with the interposing of a throttle element and a check valve, and additionally has a discharge line with a check valve.

FIG. 14 illustrates a further variation of the subject of the invention, in which the volume required for switching the 3/2-way valve 33 can be supplied to the control surface 33*a* in increments over the course of numerous consecutive movement cycles.

Seen from the connection to the no-load-stroke line 20 and in the direction of the connecting point 34*a* to the discharge line 37, the signal line 34 connected to the no-load-stroke line 20 is likewise equipped with a throttle element 39 and a spring-loaded check valve 40. Accordingly, a limited control volume is only briefly supplied to the control surface 33*a* of the 3/2-way valve 33 in the event that the front piston collar 3*b* opens the no-load-stroke port 20*a* over the course of the return-stroke movement of the percussion piston 3, thereby subjecting the port to the working pressure via the front cylinder segment 2*b*. The check valve 37*a* blocks the discharge line 37 in the direction of the connecting point 34*a* and the signal line 34 as long as the working pressure also dominates in the intermediate line 22.

After the 3/2-way valve 33 has been switched into the (right) active position, the guidance part or line 34*c,* in addition to being connected to the no-load-stroke line 20, is connected to the pressure line 8, with the interposition of the intermediate line 22, so the check valve 40 blocks the signal line 34 in the direction of the no-load-stroke line 20.

Figure 15:
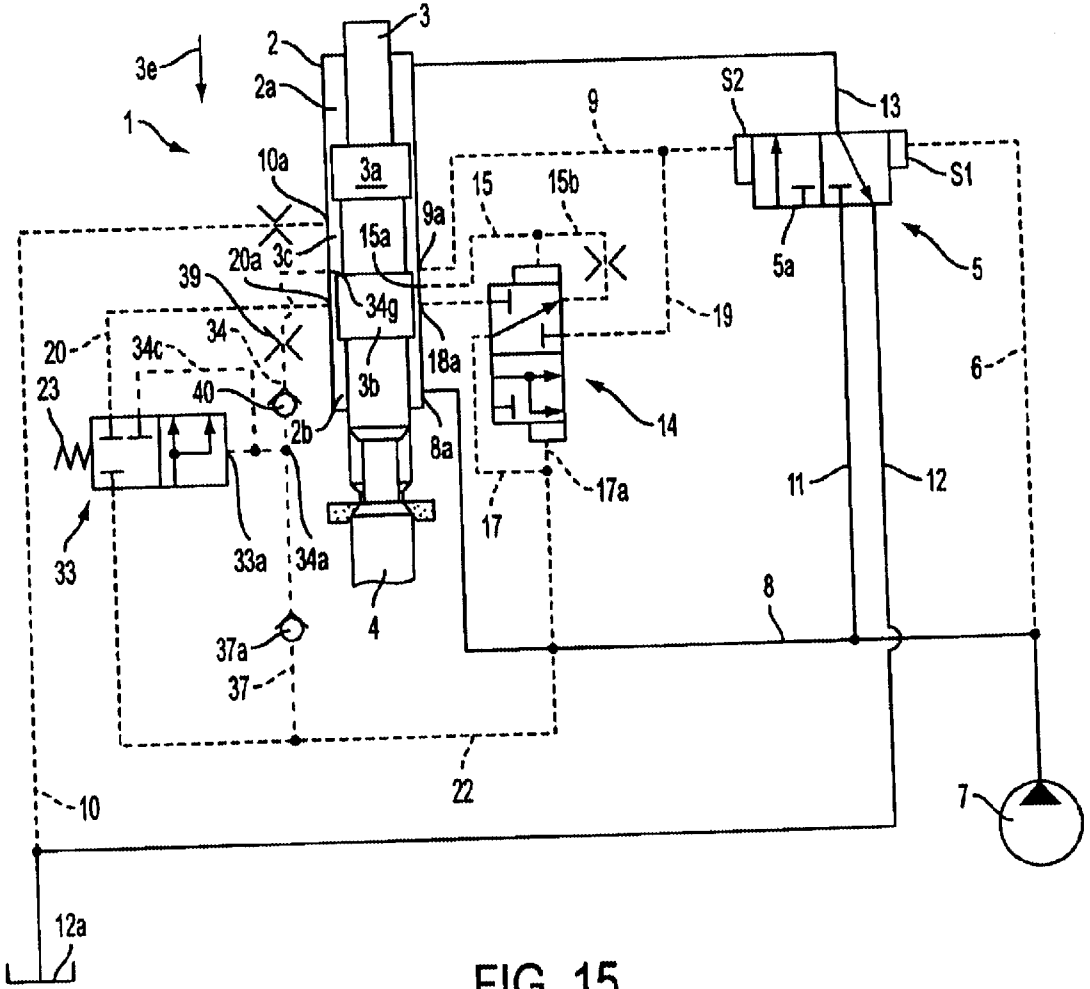
FIG. 15 shows a modification of the circuit diagram of a percussion device according to FIG. 14, with the signal line being connected to the interior of the work cylinder behind the no-load-stroke mouth—seen in the return-stoke direction of the percussion piston.

The embodiment according to FIG. 15 differs from the above-described embodiment in that the signal line 34 is connected to the interior of the work cylinder 2, separately from the no-load-stroke mouth 20*a* via a port 34*g*. Relative to the work cylinder 2, the port 34*g* of the signal line is disposed between the port 18*a* of the short-stroke line 18 and the port 9*a* of the reversing line 9, seen in the return-stroke direction of the percussion piston 3. Also in this case, the control volume acting on the control surface 33*a* is increased incrementally as soon as the front piston collar 3*b* opens the port 34*g* over the course of the return-stroke movement of the percussion piston 3, thereby exposing the port 34*g* to the working pressure present in the front cylinder segment 2*b*.

Figure 16:
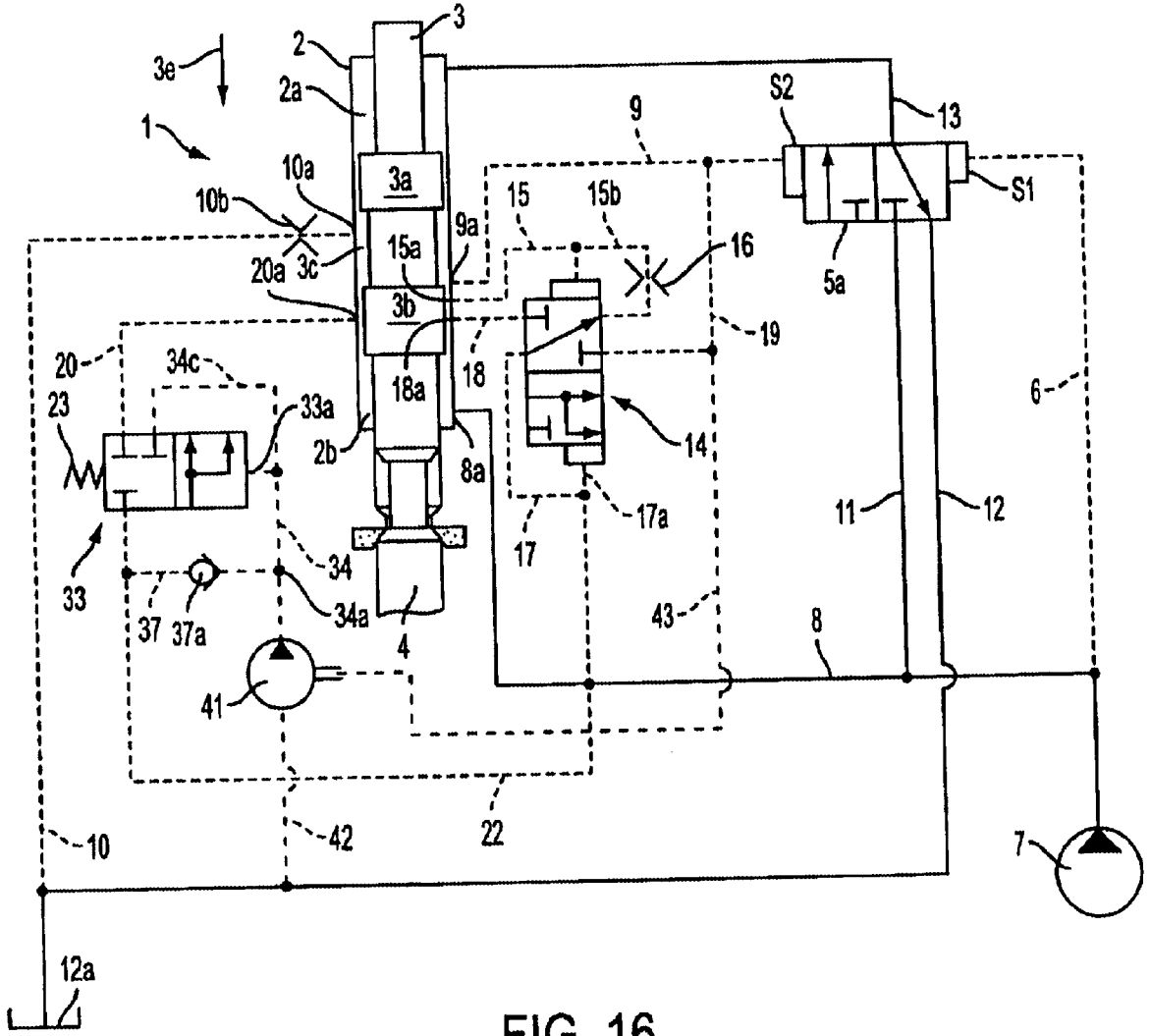
FIG. 16 is a circuit diagram of a percussion device having an automatic stroke-switching mechanism and a safety element in the form of a 3/2-way valve whose signal line is connected to a pump and has a discharge line with a check valve.

Unlike the embodiments according to FIGS. 13 through 15, the control volume required for switching the 3/2-way valve 33 can also be built up in stages by the pump 41 illustrated in FIG. 16. On the intake side, the pump 41 is connected via a suction line 42 to the pressure-relieved outlet line 12. On the discharge side, the pump 41 is connected to the discharge line 37 and the signal line 34.

For the purpose of creating a limited control volume, the pump 41 is connected via a drive line 43 to the reversing line 9. Accordingly, the pump 41 is only driven if the reversing line 9 is subjected to the working pressure, and supplies the control surface 33*a* with a constant volume per work cycle of the percussion piston 1.

To avoid an undesired stress or undesired operating state, the pump 41 is equipped internally with a check valve, not shown, which prevents a reflux counter to the pumping direction.

Within the scope of the invention, the drive line 43 of the pump 41 can connect the pump 41 to a different percussion-device line that is only temporarily subjected to the working pressure. Drawing from the variations shown in FIGS. 7 and 9, the drive line 43 of the pump 41 can particularly be connected to either the alternating-pressure line 13 (FIG. 7) or the short-stroke line 18 (FIG. 9).

Furthermore, within the scope of the solution according to the invention, the pump 41 can also be replaced by a metering valve that is controlled by a suitable percussion-device line, especially the percussion-device lines 9, 13 or 18, and supplies only a limited control volume to the control surface 33*a* in intervals. Unlike in the connections of the pump 41, the metering valve is connected to the intermediate line 22 on the intake side.

Figure 17:
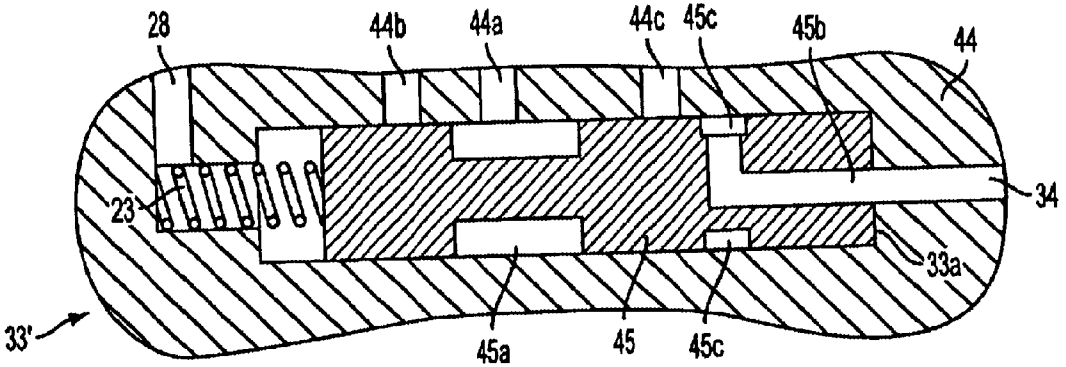
FIG. 17 shows a variation of a two-position valve corresponding in function to a 3/2-way valve, schematically and in a partial section.

FIG. 17 illustrates an embodiment variation of a two-position valve 33' serving as a safety element. This valve has a valve piston 45 that is guided to move in a housing 44 and has a spring element 23 which serves as a resetting mechanism and a leakage line 28 (see FIG. 6). The housing 44 additionally has three radial bores 44*a*, 44*b* and 44*c* disposed therein. The bores 44*a* and 44*c* are connected to the intermediate line 22, while the bore 44*b* is connected to the no-load-stroke line 20. Via the signal line 34, the control surface 33*a* can be subjected to pressure on the side of the valve piston 45 that is located opposite the spring element 23. The bore 44*a* is connected to an annular groove 45*a* in the valve piston 45. The piston 45 is also provided with a center bore 45*b*, which originates in the control surface 33*a* and likewise changes over to a (shorter) annular groove 45*c* in the valve piston 45. The center bore 45*b* represents the partial line 34*c* shown in the circuit diagram.

In the illustrated inoperative position of the two-position valve 33', the control surface 33*a* is supported against the housing 44, in the direction of the signal line 34, due to the effect of the spring element 23. The valve piston 45 or its annular groove 45*a* blocks the bores 44*a* through 44*c*. If the working pressure in the signal line 34 acts on the control surface 33*a*, the valve piston 45 is displaced inside the housing 44, counter to the effect of the spring element 23, to the left and into the active position. In this position, the annular groove 45*a* connects the bores 44*a* and 44*b*, while the annular groove 45*c* connects the control surface 33*a* and the bore 44*c* via the center bore 45*b*. At the same time, the no-load-stroke line 20 is subjected to the working pressure via the intermediate line 22, and the control surface 33*a* is subjected to the working pressure via the partial line 34*c*. The two-position valve 33' thus maintains the active position once it has been assumed. The discussion of the embodiments equipped with the 3/2-way valve 33 serves in explaining the further details.

Figure 18:
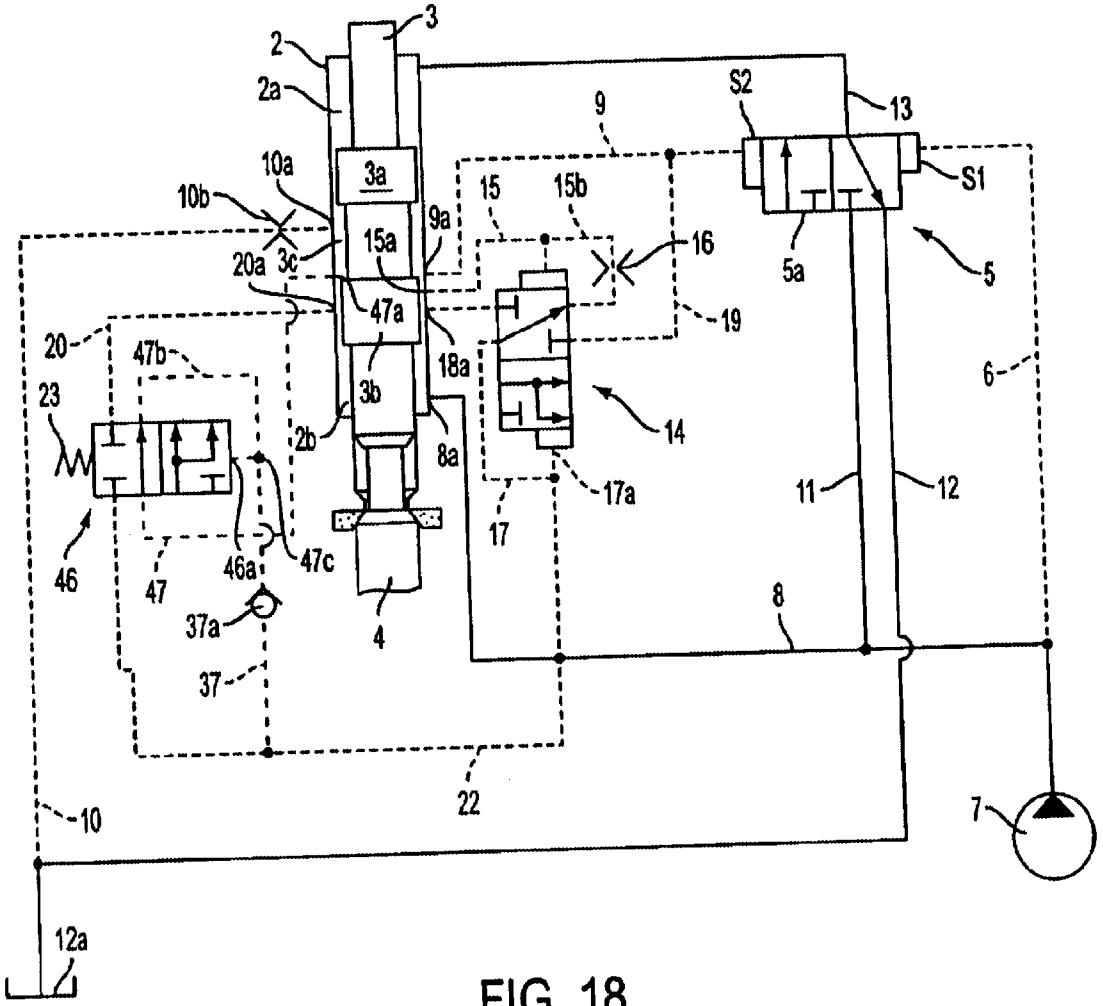
FIG. 18 is a the circuit diagram of a percussion device having an automatic stroke-switching mechanism and a safety element in the form of a 4/2-way valve and a signal line that is connected to the interior of the work cylinder outside of the no-load-stroke mouth.

The safety element can also be configured as a 4/2-way valve 46, as can be seen in FIG. 18. In such case, the intake side of the aforementioned safety element 46 is connected to the intermediate line 22, and to a signal line 47, which is in turn connected via its port 47*a* to the interior of the work cylinder 2. As already explained in connection with FIG. 15, the port 47*a* is physically separate from the no-load-stroke port 20*a* of the no-load-stroke line 20, and assumes a position between the port 18*a* of the short-stroke line 18 and the port 9*a* of the reversing line 9 relative to the work cylinder 2.

On the discharge side, the 4/2-way valve 46 is connected to the aforementioned no-load-stroke line 20, and to the guidance part 47*b* of the signal line 47, by way of which the control surface 46*a* of the 4/2-way valve can also be subjected to the pressure level dominating in the guidance part 47*b*.

At a connecting point 47*c*, the guidance part 47*b* changes over to the above-described discharge line 37, which is connected to the intermediate line 22 and is equipped with a spring-loaded check valve 37*a* that blocks in the direction of the connecting point 47*c*.

In the drawing, the 4/2-way valve 46 assumes the inoperative position due to the effect of the resetting force originating from its spring element 23. In this position, the connection between the lines 22 and 20 is broken, while a connection is present between the port 47*a*, the guidance part 47*b* and the control surface 46*a*. In the opposite active position, the lines 20 and 47*b* and the control surface 46*a* are simultaneously subjected to the working pressure via the intermediate line 22, while the connection between the port 47*a* and the guidance part 47*b* is blocked.

If, after the percussion device has started up, the front piston collar 3*b* has opened the port 47*a* during the return-stroke movement of the percussion piston 3, the signal line 47 is connected via its port 47*a*, the front cylinder segment 2*b* and the intermediate line 22 to the pressure line 8. Consequently, the working pressure also acts on the control surface 46*a* via the guidance part 47*b*, and the 4/2-way valve 41 is transferred into the (right) active position, counter to the force of the spring element 23. The valve maintains this position as long as the working pressure is present in the intermediate line 22.

The 4/2-way valve 46 can be switched back into its illustrated inoperative position after the working pressure has been cut off. In this instance, the guidance part 47*b* and the control surface 46*a* are relieved of pressure by way of the check valve 37*a*, in the direction of the intermediate line 22.

Of course, within the scope of the invention, the 4/2-way valve 46 can also cooperate with a signal line whose port 47*a* assumes a different position relative to the work cylinder, or—independently of the interior of the work cylinder 2—is connected to a suitable percussion-device line, particularly the alternating-pressure line 13, the reversing line 9 or the short-stroke line 18. In this regard, refer to the discussion of FIGS. 7 through 9 or FIG. 13.

Figure 19:
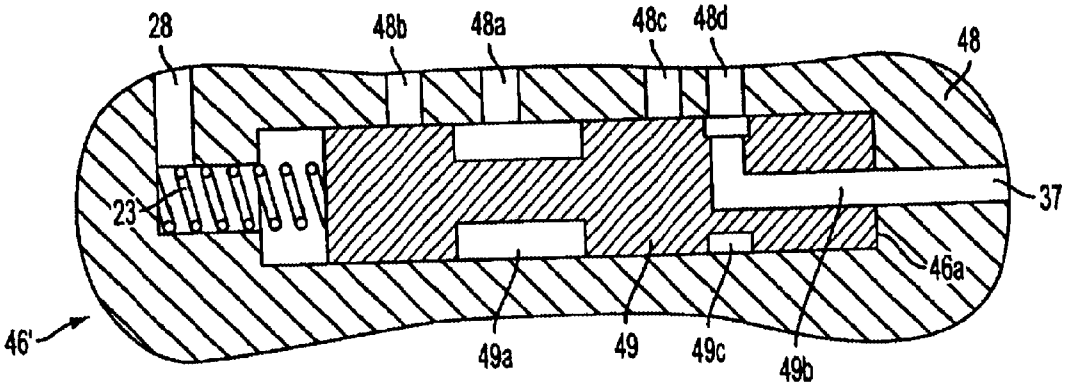
FIG. 19 shows a variation of a two-position valve corresponding in function to a 4/2-way valve, schematically and in a partial section.

As is apparent in FIG. 19, which relates to a variation of the 4/2-way valve, the multiple-position valve 46' has a valve piston 49 that is guided to move in a housing 48. The piston is supported on the left side against the aforementioned spring element 23, which is maintained in a pressure-relieved state by the leakage line 28.

In the longitudinal direction of the valve piston 49, the housing 48 has four radial bores, which are adjacent to one another and terminate into the housing, namely a bore 48*a* which is connected to the intermediate line 22, a bore 48*b*, which is connected to the no-load-stroke line 20, a bore 48*c*, which is also connected to the intermediate line 22, and a bore 48*d,* which is connected to the port 47*a.* The bore 48*a* terminates into an annular groove 49*a* disposed on the valve piston 49. On the side opposite the spring element 23, the piston 49 is provided with a center bore 49*b,* which originates from the control surface 46*a* and changes over into a further annular groove 49*c* provided on the valve piston.

As already mentioned, the control surface 46*a* can be subjected to pressure via the bore 48*d* connected to the signal line 47, and continuously or intermittently displaced in the direction of the spring element 23.

In the illustrated inoperative position of the two-position valve 46', the valve piston 49 blocks the bores 48*a* through 48*c,* while the bore 48*d* is connected to the control surface 46*a* via the annular groove 49*c* and the center bore 49*b,* and the discharge line 37. The latter is blocked by the check valve 37*a* (see FIG. 18). If the working pressure originating from the port 47*a* (see FIG. 18) is present in the bore 48*d,* the pressure also acts on the control surface 46*a.* Consequently, the valve piston moves to the left, thus switching the two-position valve 46' into its active position. In this position, the bore 48*a,* the annular groove 49*a* and the bore 48*b* connect the lines 22 and 20 to one another. The working pressure now acts continuously on the control surface 46*a* via the bore 48*c,* the annular groove 49*c* and the center bore 49*b,* so the two-position valve 46' maintains the active position once it has been assumed. This switching state is maintained as long as the branch line 22 (see FIG. 18) is exposed to the working pressure via the pressure line 8 in the operating mode of the percussion device 1. If the pressure in the branch line is relieved, the control surface 46*a* can expel fluid through the discharge line 37, so the two-position valve 46' switches into the inoperative position.

FIGS. 20*a* through 23*c* illustrate different switching arrangements of the two-position valves that serve as a safety element and can be used in the solution in accordance with the invention.

FIGS. 20–23*b* and *c* relate to embodiments that additionally permit pressure relief for the segment of the signal line by way of which the respective control surface can be acted upon. The pressure relief is effected either by means of a discharge line that is connected, with the interposing of a spring-loaded check valve, to the pressure line that is subjected to the working pressure, or with a throttle line that is kept in a pressure-relieved state through its connection to a throttle element.

Figure 20A:
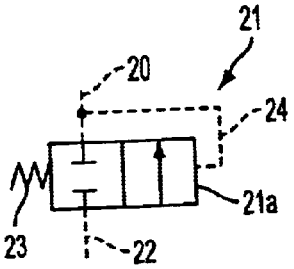
FIGS. 20*a–c* show switching arrangements of a 2/2-way valve having a signal line or additional discharge mechanism that is connected to the no-load-stroke line via a check valve or a throttle element.
Figure 20B:
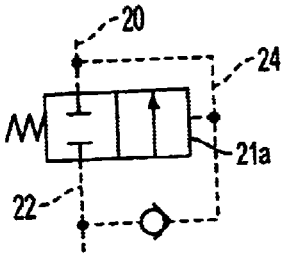
Figure 20C:
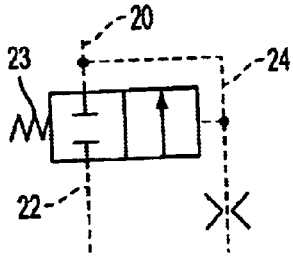

In the switching arrangements according to FIGS. 20*a* through *c,* the safety element is embodied as a 2/2-way valve—as shown, for example, in FIG. 1, and is controlled by a signal line 24, which is connected to the no-load-stroke line 20 and acts on the control surface 21*a.*

Figure 21A:
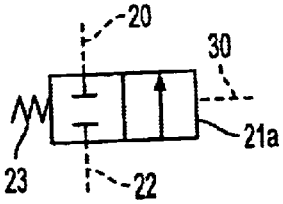
FIGS. 21*a–c* show switching arrangements of a 2/2-way valve having a signal line that is independent of the no-load-stroke line, or an additional relief mechanism in the form of a check valve or a throttle element.
Figure 21B:
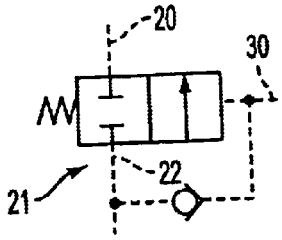
Figure 21C:
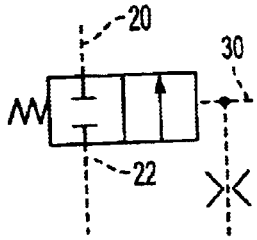

The switching arrangements according to FIGS. 21*a* through *c* relate to embodiments that employ a 2/2-way valve 21, that, as shown in FIG. 5, for example, have a signal line 30 that is independent of the no-load-stroke line 20.

Figure 22A:
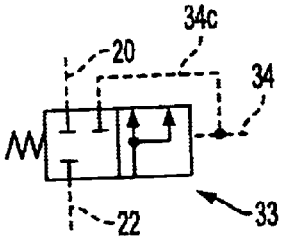
FIGS. 22*a–c* switching arrangements of a 3/2-way valve, with or without an additional relief mechanism in the form of a check valve or a throttle element.
Figure 22B:
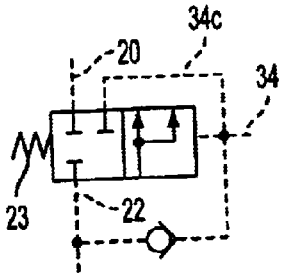
Figure 22C:
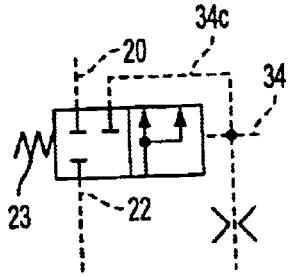

In the switching arrangements according to FIGS. 22*a* through *c,* the safety element is embodied as a 3/2-way valve 33, as shown, for example, in FIG. 7, whose signal line 34 has an additional guidance part 34*c* and can be connected to different regions of the work cylinder or to different percussion-device lines.

Figure 23A:
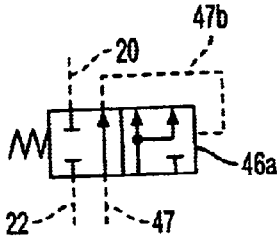
FIGS. 23*a–c* show switching arrangements of a 4/2-way valve, with or without an additional relief mechanism in the form of a check valve or a throttle element.
Figure 23B:
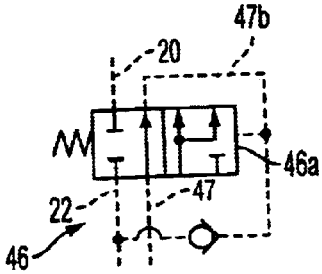
Figure 23C:
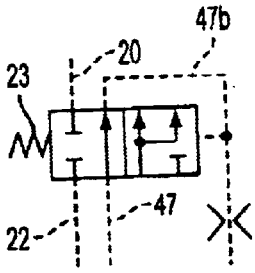

FIGS. 23*a* through *c* relate to switching arrangements having a 4/2-way valve 46, which is illustrated in FIG. 18, and a signal line 47, which also acts temporarily on the control surface 46*a* of the 4/2-way valve with the interposition of a guidance line part 47*b.*

On the intake side, the two-position valves 21, 33 or 46 are always connected to at least the intermediate line 22 that conveys the working pressure and is connected to the pressure line 8.

FIG. 13, for example, also illustrates the pressure relief of the safety element by a discharge line (FIGS. 20*b,* 21*b,* 22*b* and 23*b*).

Because the safety element is equipped with an additional throttle line, FIG. 7 is used as a reference here. The throttle line preferably is connected to the pressure-relieved return line of the percussion device following its connection to the associated throttle element (as shown in FIG. 7).

The notable advantage attained with the invention is that the percussion device is automatically protected against no-load strokes, with a very low technical outlay, with the safety element being embodied such that the percussion device can start up without an actively-switched no-load-stroke protection mechanism.

The invention now being fully described, it will be apparent to one of ordinary skill in the art that many changes and modifications can be made thereto without departing from the spirit or scope of the invention as set forth herein.

What Is Claimed Is:

1. A method for protecting a fluid-operated percussion device (1) against no-load strokes, with the percussion device having a percussion piston (3) that moves in the interior of a work cylinder (2) and impacts a tool (4), the piston having two opposed piston surfaces (A1, A2) of different sizes, of which the smaller surface (A1), which is active in the direction of a return stroke, is permanently connected to a pressure line (8) that is subjected to the working pressure, while the larger piston surface (A2), which is active in the direction of the work stroke (arrow 3*e*), is alternately connected via a control valve (5) to the pressure line and a pressure-relieved return line (10); a control unit that includes a distributing regulator (5*a*), which moves inside the control valve (5) and has two regulator surfaces that differ in size and are active in opposite directions of movement, with the smaller surface (S1), which acts on the distributing regulator (5*a*) in the direction of the return stroke of the regulator, being permanently connected to the pressure line (8), and the larger regulator surface (S2) being connected alternately and temporarily to the pressure line or the return line (8 or 10) via a circumferential groove (3*c*) on the piston disposed between the two piston surfaces (A1, A2); a no-load-stroke port (20*a*) that opens into the interior (2*d*) of the work cylinder (2), with the port first being opened toward the interior (2*d*) by a the front piston collar (3*b*) of the percussion piston (3) having the smaller piston surface (A1) after the percussion piston (3) has overshot the normal impact position by an established distance in the work-stroke direction (arrow 3*e*) until it has assumed a no-load-stroke position; and a safety element (21; 33 or 46), which is disposed upstream of the no-load-stroke port (20*a*), and can be switched between a first inoperative end position and an active second end position, and is connected on the intake side to the pressure line (8), and with the working pressure that originates from the safety element (21; 33 or 46) being exerted on the no-load-stroke port (20*a*) via of the safety element in the active position, or, in the inoperative position, serves in breaking the connection between the pressure line (8) and the no-load-stroke port (20*a*), and with the working pressure present at the no-load-port (20*a*) in the active position blocking the distributing regulator (5*a*) in the work-stroke position via the circumferential groove (3*c*), should the percussion piston (3) have attained the no-load-stroke position; and wherein said method comprises:

some time after the startup of the percussion device (1) that is subjected to the working pressure, transferring the safety element (21; 33 or 46) out of the inoperative position and into its active position counter to the effect of a resetting mechanism (23) that acts on the safety element (21; 33 or 46); and depending on the operating mode of the percussion device (1), generating an activation force opposing the resetting mechanism (23) is generated continuously, or at least temporarily in repeating intervals.

2. The method according to claim 1, including after the percussion piston has started up, transferring the safety element into its active position over the course of the first work cycle of the percussion piston.

3. The method according to claim 1, including: after the percussion piston has started up, transferring the safety element into its active position over the course of the first return-stroke movement of the percussion piston.

4. The method according to claim 1, including generating the activation force acting on the safety element by the working pressure that builds up temporarily in a percussion-device line that is periodically subjected to pressure.

5. The method according to claim 4, including temporarily transferring the safety element into its active position during a time frame, and is holding the safety element in this position while the working pressure is exerted on the percussion-device line.

6. The method according to claim 1, including building up the activation force acting on the safety element by the working pressure present in the no-load-stroke port.

7. The method according to claim 1, including transferring the safety element into its active position if the larger piston surface of the percussion piston is subjected to the working pressure after the percussion device has started up.

8. The method according to claim 1 including transferring the safety element into its active position if a larger of the two regulator surfaces of the distributing regulator is acted upon for the first time with the working pressure after the percussion device has started up.

9. The method according to claim 1, including, after the percussion device has started up, gradually transferring the safety element into its active position as a function of the operating period.

10. The method according to claim 1, including causing the safety element to execute a partial switching stroke in the direction of its active position per time unit due to the effect of a delay element, with the partial switching stroke being smaller than the switching stroke with which the safety element is transferred from the inoperative position into the active position.

11. The method according to claim 1, including supplying a limited control volume to the control surface of the safety element, as a function of pressure fluctuations occurring periodically during the operation of the percussion piston, thus causing the safety element to be transferred in increments into its active position.

12. The method according to claim 11, including creating the limited control volume by a percussion-device line that is equipped with a throttle element and is periodically subjected to the working pressure during the operation of the percussion piston.

13. The method according to claim 11, including creating the limited control volume by a pump, which executes a pumping process that supplies a constant volume per work cycle during the operation of the percussion device.

14. The method according to claim 13, including driving the pump by a percussion-device line, which is periodically subjected to the working pressure during the operation of the percussion device.

15. The method according to claim 1, including after being transferred into the active position, maintaining the safety element in this position as long as the working pressure is exerted onto the percussion device.

16. An apparatus for executing a method for protecting a fluid-operated percussion device (1) against no-load strokes, said apparatus comprising:

a percussion piston (3) that moves inside a work cylinder (2) and impacts a tool (4), with the piston having two opposed piston surfaces (A1, A2) of different sizes, of which the smaller surface (A1), which is oriented to be active in the direction of a return stroke, is permanently connected to a pressure line (8) that opens into the work cylinder and is subjected to the working pressure, while the larger piston surface (A2), which is oriented to be active in the direction of the work stroke (arrow 3*e*), is alternately connected via a control valve (5) to the pressure line and a pressure-relieved return line (10);

a control unit that includes a distributing regulator (5*a*), which moves in the control valve (5) and has two regulator surfaces that differ in size and are active in opposite directions of movement, with a smaller of the two regulator surfaces (S1), which acts on the distributing regulator (5*a*) in the direction of a return stroke of the regulator, being permanently connected to the pressure line (8), and the larger of the two regulator surfaces (S2) being connected alternately and temporarily during movement of the piston to the pressure line or the return line (8 or 10) via a circumferential groove (3*c*) disposed on the piston between the piston surfaces (A1, A2); and forms front and rear piston collars;

a no-load-stroke line having a no-load stroke port (20*a*) that opens into the interior (2*d*) of the work cylinder (2), with the port being located in the longitudinal direction of the work cylinder such that it is first opened toward the interior of the work cylinder (2*d*) by the front piston collar (3*b*) of the percussion piston (3) which has the smaller piston surface (A1), after the percussion piston (3) has overshot the normal impact position by an established distance in the direction of the work-stroke direction (arrow 3*e*) until it has assumed a no-load-stroke position; and a safety element (21; 33 or 46), which is disposed in the no-load stroke line upstream of the no-load-stroke port (20*a*), and can be switched between end positions, including an inoperative end position and an active end position, and is connected on the intake side to the pressure line (8), with the working pressure that originates from the safety element (21; 33 or 46) being exerted on the no-load-stroke port (20*a*) via the safety element when in the active end position, and breaking the connection between the pressure line (8) and the no-load-stroke port (20*a*), when in the inoperative end position, wherein the working pressure present at the no-load-port (20*a*) in the active position, blocks the distributing regulator (5*a*) in the work-stroke position via the circumferential groove (3*c*), should the percussion piston (3) have attained the no-load-stroke position;

the safety element (21; 33 or 46) is formed by an automatically-controlled two-position valve that is provided with a resetting mechanism (23) and has a control surface (21*a;* 33*a* or 46*a*) that influences its position, and can be subjected, via a signal line, to a pressure level that forms a control signal such that the two-position valve is first transferred out of its inoperative position and into its active position some time after the percussion device (1) has started up, and counter to the effect of the resetting mechanism (23); and the two-position valve (21; 33 or 46) is configured such that it maintains its active position, as effected under the influence of the control signal, at least temporarily in repeating intervals.

17. The apparatus according to claim 16, wherein the signal line (24; 30; 34; 47) is connected to a percussion-device line (20; 13; 9; 18), which is periodically subjected to the working pressure during the operation of the percussion device.

18. The apparatus according to claim 16, wherein the signal line (24) is connected to the no-load-stroke line (20), whose no-load-stroke port (20*a*) is connected to the interior (2*d*) of the work cylinder (2).

19. The apparatus according to claim 16, wherein the signal line (30) is connected to an alternating-pressure line (13), by way of which the larger piston surface (A2) of the percussion piston (3) is temporarily subjected to the working pressure.

20. The apparatus according to claim 16, wherein the signal line (34) is connected to a reversing line (9) connected between the interior of the working cylinder and the larger regulator surface, by way of which the larger regulator surface (S2) of the distributing regulator (5*a*) that constitutes the control unit is temporarily subjected to the working pressure.

21. The apparatus according to claim 16 further comprising a pilot control (14) unit that cooperates with the control unit (5), and a short-stroke line (18) that is connected to the pilot control unit as well as to the interior (2*d*) of the work cylinder (2), and wherein the signal line (34) is connected to the short-stroke line (18).

22. The apparatus according to claim 16, wherein the signal line (24; 34; 47) is connected to the interior (2*d*) of the work cylinder (2) such that it is subjected to the working pressure via a front cylinder segment (2*b*) in front of the larger piston surface, should the percussion piston (3) assume a position outside of its normal impact position when seen in the direction of the return stroke.

23. The apparatus according to claim 22, wherein the signal line (34) port (34*g*) opening into the interior (2*d*) of the work cylinder (2) is in front of the port (9*a*) for the reversing line (9) into the interior (2*d*) of the work cylinder when seen in the return-stroke direction of the percussion piston (3), but is disposed at the level of the reversing-line port (9*a*).

24. The apparatus according to claim 16, wherein a segment of the signal line (34) that is connected to the control surface (33*a*) of the safety element (33) so as to permit a flow is connected to signal source of the control signal (22; 13; 20; 41) acting on the safety element control surface such that a limited control volume is at least intermittently supplied to the control surface (33*a*) after the percussion device (1) has started up, with the volume effecting a gradual transfer of the safety element (33) into its active position.

25. The apparatus according to claim 24, wherein the segment of the signal line (34) that is connected to the control surface (33*a*) so as to permit a flow has a throttle element (36; 39) that acts as a delay element.

26. The apparatus according to claim 25, wherein the segment of the signal line (34) that is connected to the control surface (33*a*) so as to permit a flow is connected to the pressure line (8) with the interposition of a throttle element (36; 39) that acts as a delay element.

27. The apparatus according to claim 24, wherein a segment of the signal line (34) that is connected to the control surface (33*a*) of the safety element (33) so as to permit a flow, is provided with a spring-loaded check valve (34*b;* 34*e;* 40), which blocks the signal line (34) in the direction of the percussion-device line (20; 13; 9; 18), or in the direction of the interior (2*d*) of the work cylinder (2).

28. The apparatus according to claim 24, wherein the segment of the signal line (34) that is connected to the control surface (33*a*) so as to permit a flow is connected to a pump (41), that is driven such that it conveys a constant volume to the control surface (33*a*) per work cycle during the operation of the percussion device, which effects the incremental transfer of the safety element (33) into its active position.

29. The apparatus according to claim 24, wherein the segment of the signal line (34; 47) that is connected to the control surface (33*a*) so as to permit a flow is additionally connected via a discharge line (31) to the pressure line (9), which is provided with a spring-loaded check valve (37*a*) that blocks the pressure line (8) in the direction of the signal line (34; 47).

30. The apparatus according to claim 24, wherein the segment of the signal line (34) that is connected to the control surface (33*a*) so as to permit a flow is additionally connected to a throttle line (35), which via a throttle element (35*a*) connected in the throttle line is maintained without pressure.

31. The apparatus according to claim 16, wherein the safety element is embodied as an automatically-controlled 2/2-way valve (21).

32. The apparatus according to claim 16, wherein the safety element is embodied as an automatically-controlled 3/2-way valve (33), whose intake side is only connected to the pressure line, and whose discharge side is connected to the no-load-stroke port (20*a*) and the signal line (34); in the inoperative position, only the control surface (33*a*) is connected to the signal line (34); and, in the active position, the no-load-stroke port (20*a*) and the signal line (34) connected to the control surface (33*a*) are subjected to the working pressure via the pressure line (8).

33. The apparatus according to claim 16, wherein the safety element is embodied as an automatically-controlled 4/2-way valve (46), whose intake side is connected to the pressure line (8) and the signal line (47), and whose discharge side is connected to the no-load-stroke port (20*a*) and an extension (47*b*) of the signal line (47), with the extension (47*b*) being connected to the control surface (46*a*) so as to permit a flow; in the inoperative position, the connection between the pressure line (8) and the no-load-stroke port (20*a*) is broken, whereas the signal line (47) and its extension (47*b*) are connected to one another; and, in the active position, the no-load-stroke port (20*a*) and the extension (47*b*) are subjected to the working pressure via the pressure line (8), while the signal line (47) is blocked in the direction of the 4/2-way valve (46).

* * * * *